US010186412B2

(12) United States Patent
Reilly et al.

(10) Patent No.: US 10,186,412 B2
(45) Date of Patent: Jan. 22, 2019

(54) DIGITAL WAVEFORM MANIPULATIONS TO PRODUCE MS$^n$ COLLISION INDUCED DISSOCIATION

(71) Applicant: Washington State University, Pullman, WA (US)

(72) Inventors: Peter Thomas Aquinas Reilly, Pullman, WA (US); Gregory Forrest Brabeck, Pullman, WA (US)

(73) Assignee: Washington State University, Pullman, WA (US)

( * ) Notice: Subject to any disclaimer, the term of this patent is extended or adjusted under 35 U.S.C. 154(b) by 225 days.

(21) Appl. No.: 15/316,900

(22) PCT Filed: Jun. 12, 2015

(86) PCT No.: PCT/US2015/035517
§ 371 (c)(1),
(2) Date: Dec. 7, 2016

(87) PCT Pub. No.: WO2015/191976
PCT Pub. Date: Dec. 17, 2015

(65) Prior Publication Data

US 2017/0110311 A1 Apr. 20, 2017

Related U.S. Application Data

(60) Provisional application No. 62/011,494, filed on Jun. 12, 2014.

(51) Int. Cl.

| | |
|---|---|
| ***H01J 49/40*** | (2006.01) |
| ***H01J 49/42*** | (2006.01) |
| ***H01J 49/00*** | (2006.01) |

(52) U.S. Cl.
CPC ..... *H01J 49/401* (2013.01); *H01J 49/0031* (2013.01); *H01J 49/429* (2013.01)

(58) Field of Classification Search
USPC ..... 250/282, 281, 287
See application file for complete search history.

(56) References Cited

U.S. PATENT DOCUMENTS

| | | | |
|---|---|---|---|
| 2004/0079875 A1 | 4/2004 | Ding | |
| 2007/0158545 A1 | 7/2007 | Verenchikov | |
| 2017/0221694 A1 * | 8/2017 | Papanastasiou .... | H01J 49/4225 |

OTHER PUBLICATIONS

Brabeck et al.; "Mapping ion stability in digitally driven ion traps and guides"; International Journal of Mass Spectrometry, vol. 364, Mar. 25, 2014, pp. 1-8.

Brabeck et al.; "Development of MSn in Digitally Operated Linear Ion Guides"; Analytical Chemistry, vol. 86, Jun. 25, 2014, pp. 7757-7763.

* cited by examiner

*Primary Examiner* — Kiet T Nguyen
(74) *Attorney, Agent, or Firm* — W&C IP

(57) ABSTRACT

A novel method and mass spectrometer apparatus is introduced to enable collision induced dissociation inside linear ion traps/guides or 3D ion traps based on digital waveform manipulation. In particular, using the device's digitally produced trapping waveforms to trap, isolate and energize the ions of interest creates a simplified and versatile ion trap/guide that is capable tandem mass spectrometry and high sensitivity. Coupling the digitally operated ion trap/guides to a TOF creates a Q-TOF instrument that outperforms any commercial system in terms of sensitivity and capabilities.

13 Claims, 18 Drawing Sheets

DIGITAL WAVEFORM MANIPULATIONS TO PRODUCE $MS^n$ COLLISION INDUCED DISSOCIATION

STATEMENT REGARDING FEDERALLY SPONSORED RESEARCH OR DEVELOPMENT

This invention was made with government support under grant no. HDTRA1-12-1-0015 awarded by Department of Defense, Defense Threat Reduction Agency. The government has certain rights in the invention.

BACKGROUND OF THE INVENTION

Field of the Invention

The present embodiments herein relate to the field of mass spectrometry, and more particularly the present embodiments herein relate to the use of a Time of Flight (TOF) instrument in cooperation with a 2D linear multipole configured to receive digitally manipulated waveforms so as to trap, isolate and energize the ions of interest to provide collision induced tandem mass spectrometry $MS^n$ and high sensitivity.

Discussion of the Related Art

Mass spectrometry is one of the most common and most important tools in chemical analysis and became a key technique in the discovery of the electron and the isotopes. The analysis of organic compounds is especially challenging as such compounds cover a wide mass range from about 15 amu up to several hundred thousand amu, wherein the compounds themselves are often fragile and non-volatile.

In general, a mass spectrometer includes an ion source, a mass analyzer and some form of one or more detectors. As part of the function of the ion source, sample particles are ionized with techniques that can include chemical reactions, electrostatic forces, laser beams, electron beams, or other particle beams. The resultant ions are subsequently directed to one or more mass analyzers that separate the ions based on their mass-to-charge ratios. The separation can be temporal, e.g., in a time-of-flight analyzer (TOF), spatial e.g., in a magnetic sector analyzer, or in a frequency space, e.g., in ion cyclotron resonance (ICR) cells. The ions can also be separated according to their stability in a multipole (e.g., quadrupole), an ion trap or an ion guide. The separated ions are detected by detectors so as to provide data that enable the reconstruction of a resultant mass spectrum of the sample particles.

As part of the directing of the particles within a mass spectrometer, the ions are guided, trapped or analyzed using magnetic fields or electric potentials, or a combination of magnetic fields and electric potentials. For example, static electric fields are used in time of flight instruments and electrostatic traps, like the ORBITRAP™, static magnetic and static electric fields are used in ICR cells, and static and dynamic multipole electric potentials are used in multipole traps such as, two-dimensional (2D) quadrupole traps or three-dimensional (3D) quadrupole ion traps. However, while a (3D) quadrupole ion trap, e.g., Paul trap, forms a true 3D trapping potential it has only a limited space charge capacity.

With respect to linear 2D multipole traps, such devices, which can be operated as collision cells, often include multipole electrode assemblies, such as quadrupole, hexapole, octapole or greater electrode assemblies that include four, six, eight or more rod electrodes, respectively. The rod electrodes are arranged in the assembly about an axis to define a channel in which the ions are confined in radial directions by a 2D multipole potential that is generated by applying radio frequency ("RF") voltages to the rod electrodes. The ions are traditionally confined axially, in the direction of the channel's axis, by DC biases applied to the rod electrodes or other electrodes such as plate lens electrodes in the trap. Additional AC voltages can be applied to the rod electrodes to excite, eject, or activate some of the trapped ions.

In MS/MS (e.g., $MS^n$) experiment using desired multipole (e.g., quadrupole) structures, selected precursor ions are often first isolated or selected, and next reacted or activated to induce fragmentation to produce product ions. Mass spectra of the product ions can be measured to determine structural components of the precursor ions. Typically, the precursor ions are fragmented by collision activated dissociation ("CAD") in which the precursor ions are kinetically excited by electric fields in an ion trap that also includes a low pressure inert gas. The excited precursor ions collide with molecules of the inert gas and may fragment into product ions due to the collisions.

Since becoming commercially available in the mid 1990's, quadrupole time-of-flight mass spectrometers (Q-TOF-MS) have advanced through automation of instrument control and data processing and continued improvements in mass resolution, accuracy and sensitivity. These improvements permit Q-TOF-MS to be applied to biological samples using atmospheric sampling and ionization techniques such as nanospray, microspray and atmospheric pressure chemical ionization (APCI). Their rapid speed of analysis permits them to be used as detectors for liquid chromatography at high flow-rates. Another key feature is their ability to perform such MS/MS experiments with combined high sensitivity and high mass accuracy for both precursor and product ions.

One of the drawbacks of the Q-TOF-MS is the ion sampling process. Ions from a continuous atmospheric pressure source are formed into a continuous beam with only a small portion being sampled into the flight tube for mass analysis during a "scan". In theory, the percentage of the ion beam sampled into the flight can be maximized by increasing the sampling frequency and optimizing the delay and duration of the pusher pulse. It is claimed that the ion sampling duty cycle can range between 5 and 30% depending on the m/z range of ions and the instrumental parameters. In practice, users do not generally optimize the sampling duty cycle for each new sample and range. As a result, the fraction of analytes detected to the analytes injected into the TOF is usually significantly smaller than projected by the optimized instrument duty cycle. This presents a significant sensitivity loss.

Another consequence of the ion sampling process is the inability to collect and concentrate analyte ions. The solution concentration has to be within a specific range in order to produce an optimal response from the detector. This represents a challenge in protein analysis that stems from sample complexity. For example, protein concentrations in human blood plasma can vary by as much as 10 orders of magnitude. The dynamic range of commercial Q-TOF-MS systems is claimed to be approximately 5 orders of magnitude under the best conditions. Consequently, there is a need to improve the analyzable concentration range.

The ion trap mass spectrometer (ITMS), such as the linear 2D ion trap as discussed briefly above, on the other hand has the ability to collect, isolate and concentrate ions. It is the ability to control the number and range of ions being analyzed and the ability to perform $MS^n$ that make ion traps good instruments for quantitative analysis. Automatic gain control makes ion traps useful for quantitation by adjusting the number of ions in the trap to maintain a linear detector response and negate space charge effects. They are also fast and sensitive enough to be used as detectors for chromatography. The resolving power of ion traps depends mostly on scan speed, with higher resolving power achieved at slower scan speeds.

Accordingly, a need exists for improved methods and configurations to capitalize on the traits of the TOF-MS and ITMS to obtain a much more powerful instrument. The embodiments disclosed herein is directed to such a need.

SUMMARY OF THE INVENTION

It is to be appreciated that the present embodiments herein are directed to duty cycle manipulation so as to trap and eject ions with a duty cycle defined amount of energy into a gas filled collision chamber for fragmentation so as to in a novel fashion, thereafter provide MS/MS. It is also to be noted that while digital waveform duty cycle, as detailed herein, can be used to axially trap and eject ions, it can also be used to narrow the range of radial ion stabilities while axially trapping or ejecting.

Notably, isolation by duty cycle is limited to the precision with which the duty cycle can be instrumentally defined. Usually 8 bit–$2^8$=256. Isolation by frequency jump depends on the precision with which the frequency can be defined, for example, up to 48 bit-$2^{48}=3\times10^{14}$ of precision. With respect to fragmentation and thus MS/MS in particular, the ions can be jumped into an unstable region for a specific number of cycles to induce ion excitation and then jumped back into a stable region. Jumping back and forth can be used to control the excitation of the parent ion. It is to be appreciated however that movement into the unstable region can be accomplished by jumping the frequency to move the ions into the unstable region or by jumping the duty cycle to move the stability boundary so that the ion is no longer stable at that frequency. A very surprising and novel aspect of the applications described herein is that the frequency can also be changed to move the ion to a point near the boundary on the stable side. This proximity to the boundary increases the amplitude of the secular oscillation while keeping the ion trapped. Collisions with the buffer gas slowly increase the internal energy of the ion until it dissociates. The fragment ions rapidly cool through buffer gas collisions and are not excited by the boundary.

With respect to jumping as described above, it is to be appreciated that ion ejection is not instantaneous after the jump to the unstable region. Several iterations of the ejecting waveform have to be experienced before the ion absorbs enough energy to eject from the trap. To use the jump to excite the molecules without ejecting them, the number of cycles experienced has to be controlled. The waveform generator (WFG) utilized herein is thus designed to agilely switch the frequency or duty cycle for a precise number of cycles into the unstable region and back again to allow the ions to remain stable as they undergo collisions to increase their internal energy. The jump procedure is then executed over and over again to build up the internal energy enough for it to fall apart. Preferably the WFG performs the frequency jumps phase coherently so that a precise amount of excitation can be accomplished with each jump.

DETAILED DESCRIPTION

Figure 1:
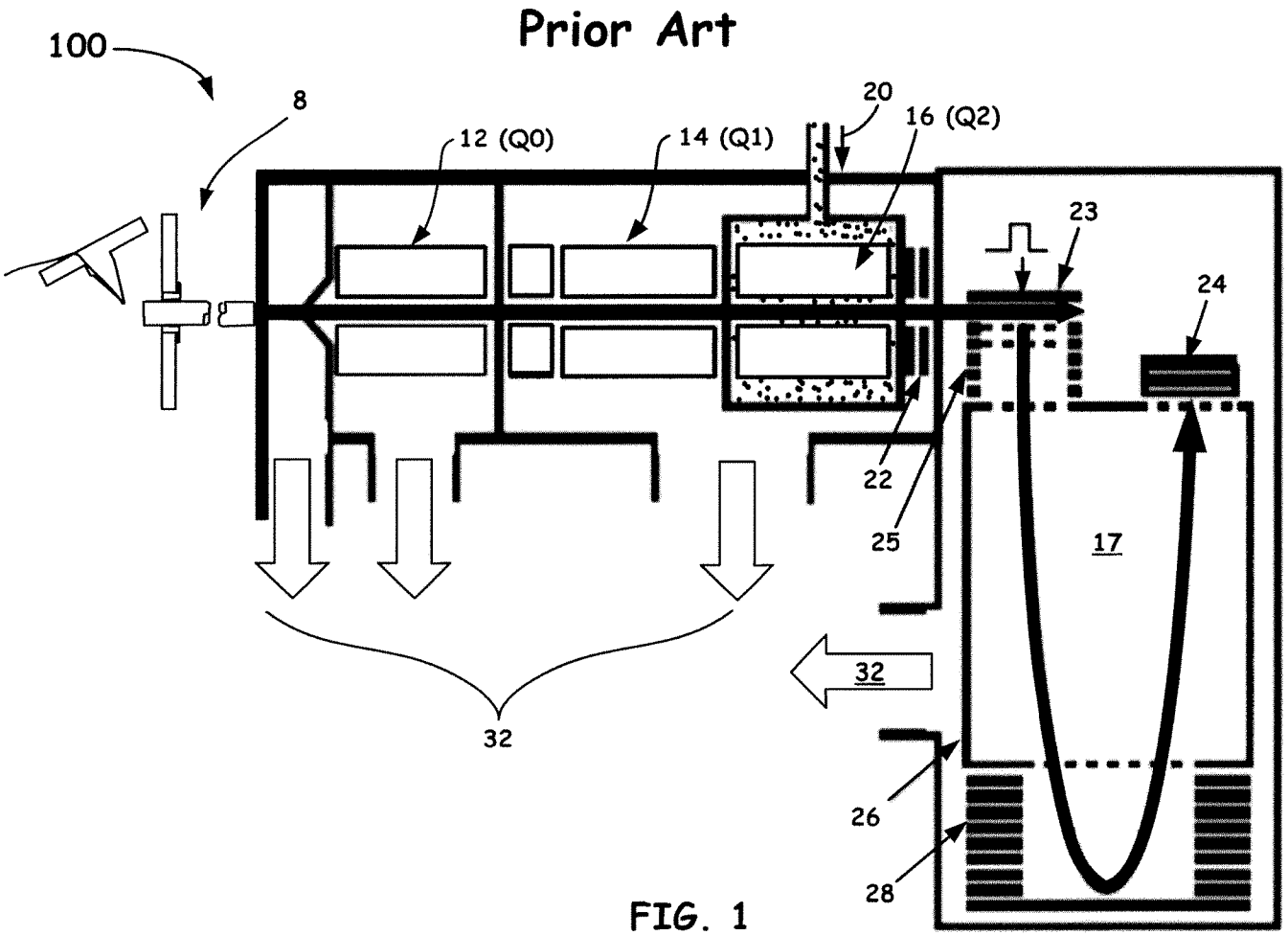
FIG. 1 shows a general schematic of a conventional Q-TOF mass analyzer system.

In the description of the invention herein, it is understood that a word appearing in the singular encompasses its plural counterpart, and a word appearing in the plural encompasses its singular counterpart, unless implicitly or explicitly understood or stated otherwise. Furthermore, it is understood that for any given component or embodiment described herein, any of the possible candidates or alternatives listed for that component may generally be used individually or in combination with one another, unless implicitly or explicitly understood or stated otherwise. It is to be noted that as used herein, the term "adjacent" does not require immediate adjacency. Moreover, it is to be appreciated that the figures, as shown herein, are not necessarily drawn to scale, wherein some of the elements may be drawn merely for clarity of the invention. Also, reference numerals may be repeated among the various figures to show corresponding or analogous elements. Additionally, it will be understood that any list of such candidates or alternatives is merely illustrative, not limiting, unless implicitly or explicitly understood or stated otherwise.

In addition, unless otherwise indicated, numbers expressing quantities of ingredients, constituents, reaction conditions and so forth used in the specification and claims are to be understood as being modified by the term "about." Accordingly, unless indicated to the contrary, the numerical parameters set forth in the specification and attached claims are approximations that may vary depending upon the desired properties sought to be obtained by the subject matter presented herein. At the very least, and not as an attempt to limit the application of the doctrine of equivalents to the scope of the claims, each numerical parameter should at least be construed in light of the number of reported significant digits and by applying ordinary rounding techniques. Notwithstanding that the numerical ranges and parameters setting forth the broad scope of the subject matter presented herein are approximations, the numerical values set forth in the specific examples are reported as precisely as possible. Any numerical values, however, inherently contain certain errors necessarily resulting from the standard deviation found in their respective testing measurements.

General Description

As briefly discussed above, a 2D multipole trap, often a 2D quadrupole trap is a beneficial device in detecting low abundance product ions as well as providing larger signal-to-noise ratios. As known to those skilled in the art, the RF voltages within such conventional instruments create a pseudo-potential that is charge sign independent but requires further electrical and magnetic fields for three-dimensional trapping and induced kinetically excitation by electric fields via sinusoidal secular frequency excitation.

It is known that such linear 2D trapping devices, as utilized as part of a mass spectrometer system, most often incorporates four, six, eight, or more equally spaced electrodes often configured in a substantially spherical arrangement to enable high efficiency capture, transmission, and/or storage of desired ions. Moreover, the ion trap can also be provided with a buffer inert gas, e.g., Helium, Neon, Argon, and most often Nitrogen to assist the ions in losing their initial kinetic energy via low energy collisions.

As also known to those skilled in the art, there is typically no axial force acting on an ion on the z-axis of the quadrupole ion trap and thus it is necessary to apply an additional DC potential gradient (i.e., DC electric field) along the z-direction in order to push ions in the z-direction. It is to be appreciated that the applied voltages to the gradient producing electrodes along the axis of the devices used herein are on the order of volts up to tens of volts. Such a distinct coupled additional DC offset voltage gradient(s) can be implemented often by, but not limited to, using one or more DC axial field electrodes, as known and understood in the art, which can be situated external to or integrated with or between the electrode structures that make up the multipole trapping devices described herein. To assist in the production of the coupled DC fields, known components and circuitry, such as, computers, DC voltage supplies, DC controllers, digital to analog converters (DACS), and programmable logic controllers for dynamic control of the coupled DC voltages are integrated into the present invention so as to move, isolate, and/or trap ions along desired directions within the apparatus described herein. Moreover, because voltage supplies required to provide the various DC voltage levels and waveforms are capable of being controlled via, for example, a computer, the magnitude and range of voltages may be adjusted and changed to meet the needs of a particular sample or set of target ions to be analyzed.

It is also to be appreciated that one or more ion lenses known by those of ordinary skill in the art can also be introduced to guide desired ions along a predetermined ion path. Such ion lenses can include, but are not limited to, lens stacks (not shown), inter-pole lenses, conical skimmers, gating means, (e.g., split gate lenses), etc., to cooperate with the multipole trapping devices of the present invention so as to also direct predetermined ions along either longitudinal direction and to also direct desired ions, often reacted ions to other subsequent sections and/or downstream instruments such as, for example, mass analyzers that include a Time of Flight (TOF) mass spectrometers.

Turning now to the drawings, FIG. 1 illustrates a conventional Q-TOF mass analyzer system, as generally designated by the reference numeral 100. In particular, the conventional system includes an example ion source (e.g., an ESIR source 8) and a higher pressure ion guide 12 (Q0) (e.g., a multipole) followed by a dual quadrupole 14 Q1 and 16 Q2 configured with a gas inlet 20 to enable 16 Q2 to operate as a collision cell. Such components are followed by an orthogonal acceleration reflection time-of-flight (TOF) mass analyzer. It is known that such desired components are often configured in a series of chambers of progressively reduced pressure that operationally guide and focus such ions to provide good transmission efficiencies. The various chambers communicate with corresponding ports 32 (represented as arrows in the figure) that are coupled to a set of pumps (not shown) to maintain the pressures at the desired values. Other conventional components known to those skilled in the art include ion optics 22, an ion modulator 23 an accelerating column 25, a shield 26 and a reflectron 28 and an eventual detector 24 (e.g., a micro-channel plate) configured in the TOF 17 region.

Many different configurations of this basic instrument exist but the basic configuration and operation is essentially the same. It is to be noted that 16 Q2 is the component that provides MS/MS. The first quadrupole 14 Q1 in the dual quad chamber is used as a mass filter to select and isolate the mass-to-charge ratio (m/z) of the analyte ions to be fragmented. The next ion guide 16 Q2 is the aforementioned gas filled collision cell. Ions from the mass filter are energetically injected into the collision cell 14 where they fragment upon collision with introduced gas through inlet 20 and then the product ions emerge from the collision cell pass through focusing optics (e.g., ion optics 22) and then directly into the ion modulator 22 of the TOF. The ion stream into the TOF 17 is continuous. The ion modulator 22 pulses the orthogonal extraction field so that a small portion of the ion stream coming out of the final quad is pushed into the TOF 17 flight tube for mass analysis. In this case the less than desirous sensitivity results because the fraction of ions that actually get analyzed relative to the number of ions that pass into the Pusher is tiny. In particular, most of the analyte ions in the ion beam do not get mass analyzed. The result is a large loss of sensitivity that is known as the Q-TOF duty cycle, not to be confused with the waveform duty cycle. If the range of masses analyzed can be limited, the Q-TOF duty cycles that have been reached have been 5 to as much as 30% better. However, under normal or typical operation, the Q-TOF duty cycle is generally much less. Such a system also cannot perform MS″.

Other conventional instruments, however, incorporate an ion trap as a pusher for the TOF 17 mass analyzer. This allow the ions from the input stream to be collected. Because they are collected in an ion trap, MS″ can be performed by the addition of a pulsed buffer gas. After the buffer gas is pumped away, the trap electrodes are pulsed and the contents of the trap are analyzed by TOF. While this solves the issue of loss due to poor Q-TOF duty cycle, it presents another issue, trapping efficiency. The trapping efficiency of an ion trap has been claimed to be as high as 1%. In other words, 1 out of every 100 ions that enter the trap actually traps while the rest pass right on through the trap. Adding a 3 dimensional ion trap to the TOF does not actually significantly improve the sensitivity although it does permit MS″.

The present example embodiments, by contrast, is directed to new methods for not only isolating and trapping desired populations of ions but for performing collision induced dissociation of the ions inside linear ion traps/guides or 3D ion traps based on digital waveform manipulation to also enable MS″. In particular, the waveform duty cycle and frequency can be manipulated to kinetically excite or energize trapped ions so that collisions with a buffer gas can induce dissociation of isolated ions. The product ions can then be mass analyzed to provide identification and characterization of the isolated analyte ions.

The novelty of this methodology of excitation lies in the use of digital multipolar (quadrupolar, hexapolar, octapolar, etc.) waveform manipulation to energize the ions instead of applying dipolar waveforms or using a separate power supply to create a change in the DC axis potential. Using the device's digitally produced trapping waveforms to trap, isolate and energize the ions of interest creates a simplified and versatile ion trap/guide that is capable of tandem mass spectrometry and high sensitivity. Coupling the digitally operated ion trap/guides to a TOF creates a Q-TOF instrument that will outperform any commercial system in terms of sensitivity and capabilities. A Q-TOF with this technology can be constructed to provide a sampling duty cycle near 1, enhanced resolving power, improved sensitivity and extended mass range as well as MS″ capability. Using this technology to create, for example, a Q-TOF produces an instrument that solves a number of sensitivity issues that plague current commercial Q-TOF and Ion Trap-TOF instruments.

Specific Description

As discussed above, the basis of the present invention is directed to performing collision induced dissociation inside linear ion traps/guides or 3D ion traps based on digital waveform manipulation. Waveform duty cycle and frequency can be manipulated to kinetically excite or energize trapped ions so that collisions with a buffer gas can induce dissociation of isolated ions. The product ions can then be mass analyzed to provide identification and characterization of the isolated analyte ions.

Figure 2:
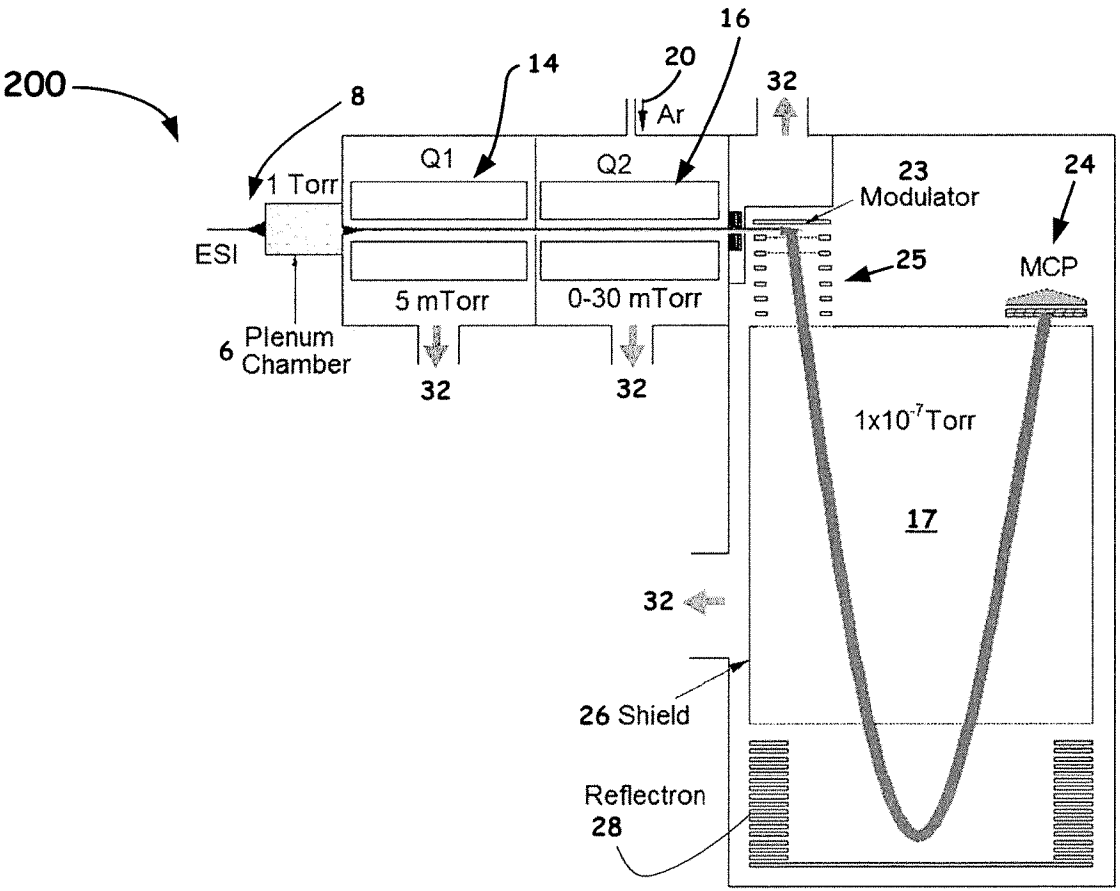
FIG. 2 shows a general schematic of a Q-TOF mass analyzer system utilized by the example embodiments disclosed herein.

Turning back to the drawings, the system 200 of FIG. 2 is shown as a general exemplary configuration that can be utilized herein and is denoted with like reference numbers from the system shown in FIG. 1. It is to be appreciated that while system 200 is utilized for illustrative purposes of the example novel embodiments of the present invention, it is to be understood that other alternative commercial and custom configurations having various other components can also be incorporated when using the techniques of the present application. In addition, the ion traps, as disclosed herein, can also be combined with other beneficial features that are known in the industry, such as, but not limited to, Normalized Collision Energy, Stepped Normalized Collision Energy, as well as Automatic gain control (AGC). AGC in particular, includes first injecting ions into the ion trap for some predetermined time using some gating optical element, typically in a pre-scan. A measurement of the resultant signal in the pre-scan is taken, and a calculation is then performed to determine what injection time (i.e. how long the gate is open) is needed to yield a specified "target" amount of signal, the target being the optimum signal which avoids saturation or space charge effects in the trap.

The example system 200 of FIG. 2 thus illustrates a Q-TOF arrangement that solves the aforementioned problems discussed above for the conventional system 100. The quadrupoles in the instrument are operated digitally. It is to be noted that that while the schematics in FIGS. 1 and 2 look strikingly similar, the main difference in the form of the instruments is at the front end or inlet system. In particular, the differentially pumped inlet and Q0 12 is replaced with an inlet orifice and a plenum chamber 6. The plenum chamber 6 is pumped by the Q1 chamber turbo pump (not shown) for simplification but the instrument shown in FIG. 2 is equally capable of operating with the differentially pumped inlet and Q0 shown in FIG. 1. In any event, the system in FIG. 2, much like the system in FIG. 1, also includes, but is not limited to, various chambers communicating with corresponding ports 32 (represented as arrows in the figure) that are coupled to a set of pumps (not shown) to maintain the pressures at the desired values. Other conventional components known to those skilled in the art include ion optics (not referenced), an ion modulator 23 an accelerating column 25, a shield 26 and a reflectron 28 and an eventual detector 24 (e.g., a micro-channel plate (MCP)) configured in the TOF 17 region.

In operation, mass spectrometer 200 is controlled and data is acquired and processed by a control and data system (not depicted) of various circuitry of a known type, which may be implemented as any one or a combination of general or special-purpose processors (digital signal processor (DSP)), firmware, software to provide instrument control and data analysis for mass spectrometers and/or related instruments, and hardware circuitry configured to execute a set of instructions that embody the prescribed data analysis and control routines of the present invention. Such processing of the data may also include averaging, scan grouping, deconvolution, library searches, data storage, and data reporting.

It is also to be appreciated that instructions to start the identifying of a set of m/z values within the raw file from a corresponding scan, the merging of data, the exporting/displaying/outputting to a user of results, etc., may be executed via a computer based system (e.g., a controller) which includes hardware and software logic for performing the aforementioned instructions and control functions of the mass spectrometer 200.

In addition, such instruction and control functions, as described above, can also be implemented by system 200, as shown in FIG. 2, as provided by a machine-readable medium (e.g., a computer readable medium). A computer-readable medium, in accordance with aspects of the present invention, refers to mediums known and understood by those of ordinary skill in the art, which have encoded information provided in a form that can be read (i.e., scanned/sensed) by a machine/computer and interpreted by the machine's/computer's hardware and/or software.

Thus, as mass spectral data of a given spectrum is received by a beneficial mass spectrometer 200 system disclosed herein, the information embedded in a computer program of the present invention can be utilized, for example, to extract data from the mass spectral data, which corresponds to a selected set of mass-to-charge ratios. In addition, the information embedded in a computer program of the present invention can be utilized to carry out methods for normalizing, shifting data, or extracting unwanted data from a raw file in a manner that is understood and desired by those of ordinary skill in the art.

Figure 3:
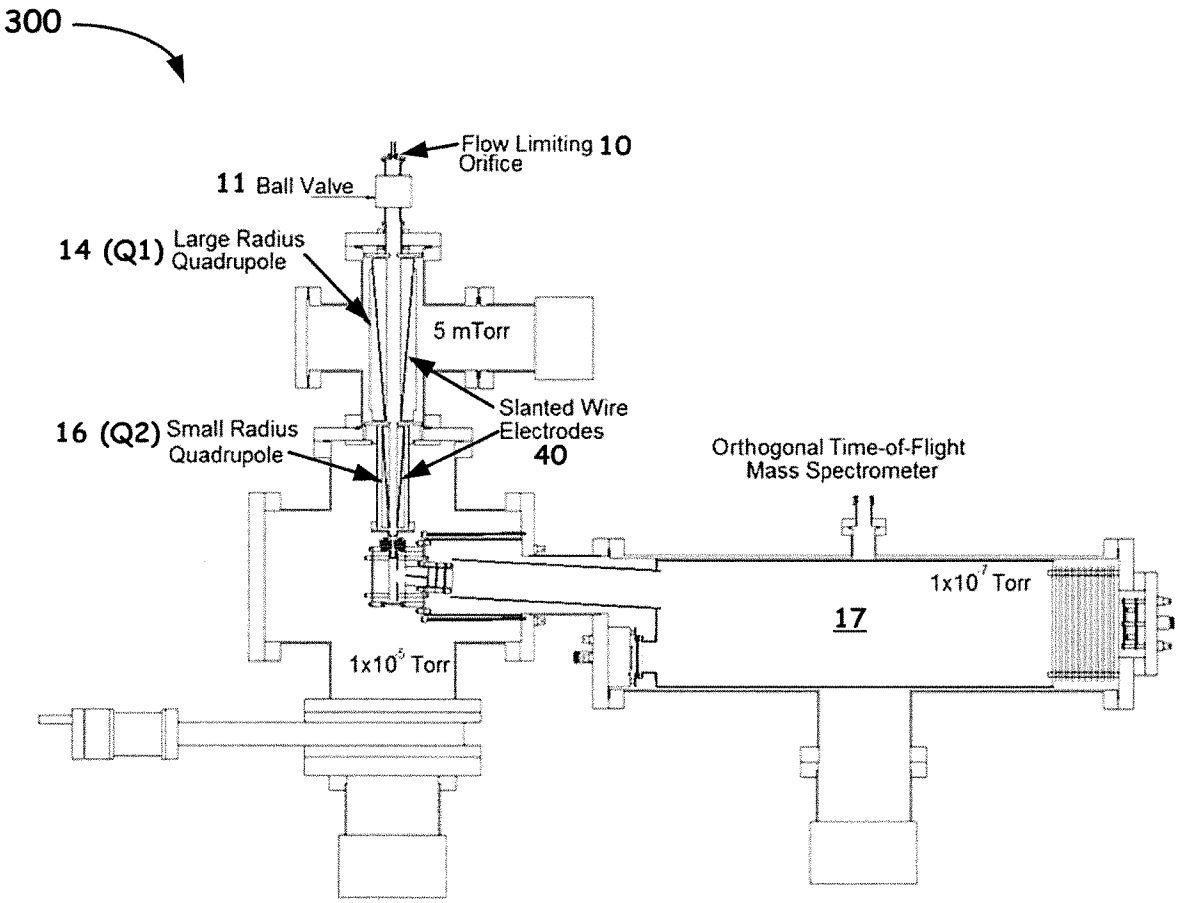
FIG. 3 schematically shows a more detailed Q-TOF mass analyzer illustration of the system shown in FIG. 2

FIG. 3 shows a more detailed version of an exemplary system that can be utilized by the methods herein, generally referenced by the numeral 300, which was similarly discussed above for the general schematic embodiment of FIG. 2. In operation of system 300, a sample containing one or more analytes of interest can be ionized via an ion source (not shown) using any of the applicable techniques known and understood by those of ordinary skill in the art. Such techniques can include, but are not strictly limited to, Electron Ionization (EI), Chemical Ionization (CI), Matrix-Assisted Laser Desorption Ionization (MALDI), Electrospray Ionization (ESI), Atmospheric Pressure Chemical Ionization (APCI), Nanoelectrospray Ionization (NanoESI), and Atmospheric Pressure Ionization (API), etc. However, the ions shown in FIG. 3 are generated at atmospheric pressure by electrospray ionization and sampled into the instrument via an inlet (not detailed) that includes a flow limiting orifice 10 and a ball valve 11. The ions and carrier gas expand into the plenum chamber (as discussed for FIG. 2) that exits only into the large radius quadrupole, 14 (i.e., Q1), chamber. There is no differential pumping of the plenum chamber. Every gas molecule that enters through the flow limiting orifice expands into the quadrupole 14 Q1 through a 4-mm orifice (not shown) whereupon the ions are caught by the quadrupole field and the carrier gas molecules are pumped away by a 250 μs turbo pump (not shown). The pressure in the plenum chamber is on the order of 500 mTorr. The pressure in the large radius quadrupole (LRQ) 14 Q1 chamber is often about 5 mTorr.

The ions are continuously transmitted via methods and components known in the art through the quadrupoles Q1 14, Q2 16 and into the orthogonal TOF 17 for mass analysis. Q1 14 is often digitally operated, using novel techniques disclosed herein, as a mass filter for ion selection and the ions can be energetically injected into the gas filled quadrupole Q2 16 (a large radius quadrupole (LRQ)) to provide for collision induced dissociation and the product ions can continuously be transmitted into the modulator 22 of the TOF 17. In particular, collisions with the buffer gas in the LRQ Q2 16 chamber quickly eliminate the translational kinetic energy induced by the low pressure expansion from the plenum chamber and the ions are stopped inside the LRQ Q2 16. Slanted wire electrodes 40 (auxiliary electrodes) inserted between the quadrupole rods create z axis fields that continually force the ions towards the orthogonal acceleration time-of-flight mass spectrometer (oa-TOF-MS). The waveforms of the LRQ Q2 16 and small radius quadrupole (SRQ) Q1 14 are digitally produced and manipulated so that ions can be axially trapped or ejected on demand by either quadrupole. Digital waveform manipulation permits ion isolation and tandem mass spectrometry to be performed inside the quadrupoles followed by controlled ion injection into the oa-TOF for resolved mass analysis.

It is thus to be appreciated that the instrument shown in FIG. 3 that is a more detailed version of FIG. 2 can operate in an identical manner as commercially available Q-TOF instruments but provides much more beneficial aspects, as to be discussed below.

With respect to the first quadrupole Q1 14 in system 300, Q1 14 can be digitally operated, as stated above, to continuously collect ions and move them to the end of Q1 14 where they can be ejected on demand into Q2 16 by switching the waveform duty cycle as discussed in J. Lee, M. A. Marino, H. Koizumi, P. T. A. Reilly, Simulation of duty cycle-based trapping and ejection of massive ions using linear digital quadrupoles: The enabling technology for high resolution time-of-flight mass spectrometry in the ultra-high mass range, Int. J. Mass Spectrom, 304 (2011) 36-40, the material of which is incorporated herein. The Q2 16 can collect the product ions at the end of Q2 16 and then eject the ions in a collimated plug into the TOF for resolved mass analysis. Q2 can also be used to narrow the range of collected ions and concentrate the ions of interest from multiple injections from Q1. Finally, frequency jumping can be used to precisely isolate the ions, as discussed in R. Singh, V. Jayaram, P. T. A. Reilly, Duty Cycle-Based Isolation in Linear Quadrupole Ion Traps, Int. J. Mass Spectrom, 343-344 (2013) 45-49, also incorporated herein by reference in its entirety. The novelty herein which is to be noted is to also manipulate the frequency of the device so that the frequency can be jumped for a specific number of waveform cycles into an unstable region to energetically excite the ion of interest and then promptly jump to a stable region where the excited ions can undergo collisions to induced dissociation. This excitation process can be done over and over again until the analyte ions are completely fragmented. The MS/MS process can be done over and over again because Q2 16 can isolate ions as well as dissociate them. The product ions can be analyzed on demand by ejecting them into the TOF by known methods for resolved mass analysis.

With respect to Q2 16, operating as an example linear trap device shown in FIG. 3, it is known to those of ordinary skill in the art that such components often comprise pairs of opposed elongated electrodes aligned across orthogonal X and Y dimensions. As part of the configuration, predetermined apertures enable expulsion of ions for subsequent detection. Although quadrupole arrangements are often beneficially utilized, other multipole configurations, such as, for example, hexapoles, octupoles, decapoles, etc., can also be utilized within a mass spectrometer system 200 that uses the methods of operation of the present invention.

In any case, the ability to perform MS″ in a linear quadrupole (i.e., ion trap such as Q2 16) has enormous beneficial aspects, as capitalized by the embodiments herein, over other similar commercial instruments. It can trap the ions and increase the Q-TOF duty cycle to nearly 100%. Transferring ions into and out of the linear trap quadrupoles is nearly 100% efficient unlike 3 dimensional ion traps. It has all the benefits of an ion trap system while having nearly 100% ion trapping efficiency. The other beneficially feature is that a digitally operated system with respect to such a component has is control over the trapping frequency.

Resonantly tuned sinusoidal ion traps and guides have a limited mass range. However, digitally operated traps and guides have no real mass limit. The present application provides embodiments to analyze singly charged ions out to 500,000 mass units by time-of-flight mass spectrometry. While this is a real beneficial aspect of digitally operated guides and traps, this application is about using digital waveform manipulation to produce an efficient ion trap system out of digitally operated linear ion guides.

Stability Diagrams for Digital Ion Traps

The trajectory of ions in an ideal conventionally operated quadrupole is modeled by the Mathieu equation. The Mathieu equation describes a field of infinite extent both radially and axially, unlike the real situation in which the rods have a finite length and finite separation. The solutions of the Mathieu equation, as known to those skilled in the art, can be classified as bounded and non-bounded. Bounded solutions correspond to trajectories that never leave a cylinder of finite radius, where the radius depends on the ion's initial conditions. Typically, bounded solutions are equated with trajectories that carry the ion through the quadrupole to the detector. For finite rods, some ions with bounded trajectories hit the rods rather than passing through to the detector, i.e., the bound radius exceeds the radius of the quadrupole orifice. Conversely, some ions with marginally unbounded trajectories pass through the quadrupole to the detector, i.e., the ion reaches the detector before it has a chance to expand radially out to infinity. Despite these shortcomings, the Mathieu equation is still very useful for understanding the behavior of ions in a finite quadrupole, such as that used in the present invention.

The Mathieu equation can be expressed in terms of two unitless parameters, a and q. The general solution of the Mathieu equation, i.e., whether or not an ion has a stable trajectory, depends only upon these two parameters. The trajectory for a particular ion also depends on a set of initial conditions—the ion's position and velocity as it enters the quadrupole and the RF phase of the quadrupole at that instant. If m/z denotes the ion's mass-to-charge ratio, U denotes the DC offset, and V denotes the RF amplitude, then a is proportional to U/(m/z) and q is proportional to V/(m/z). The plane of (q, a) values can be partitioned into contiguous regions corresponding to bounded solutions and unbounded solutions. The depiction of the bounded and unbounded regions in the q-a plane is called a stability diagram, as is to be discussed in detail below with respect to FIG. 2A. The region containing bounded solutions of the Mathieu equation is called a stability region. A stability region is formed by the intersection of two regions, corresponding to regions where the x- and y-components of the trajectory are stable respectively. There are multiple stability regions, but conventional instruments involve the principal stability region. The principal stability region has a vertex at the origin of the q-a plane. Its boundary rises monotonically to an apex at a point with approximate coordinates (0.706, 0.237) and falls monotonically to form a third vertex on the a-axis at q approximately 0.908. By convention, only the positive quadrant of the q-a plane is considered. In this quadrant, the stability region resembles a triangle.

By contrast, in a digital ion trap, (DIT) the AC (i.e., RF) voltage, V, is not generally changed, a DC voltage U between the waveforms is not normally applied, and only the frequency and waveform duty cycle are changed. Because both a and q are inversely proportional to the square of the frequency, a stability diagram with a and q for axes is not helpful. Thus, for the present embodiments disclosed herein, stability diagrams with m/z and F for axes for constant duty cycle conditions are instead created.

Figure 4:
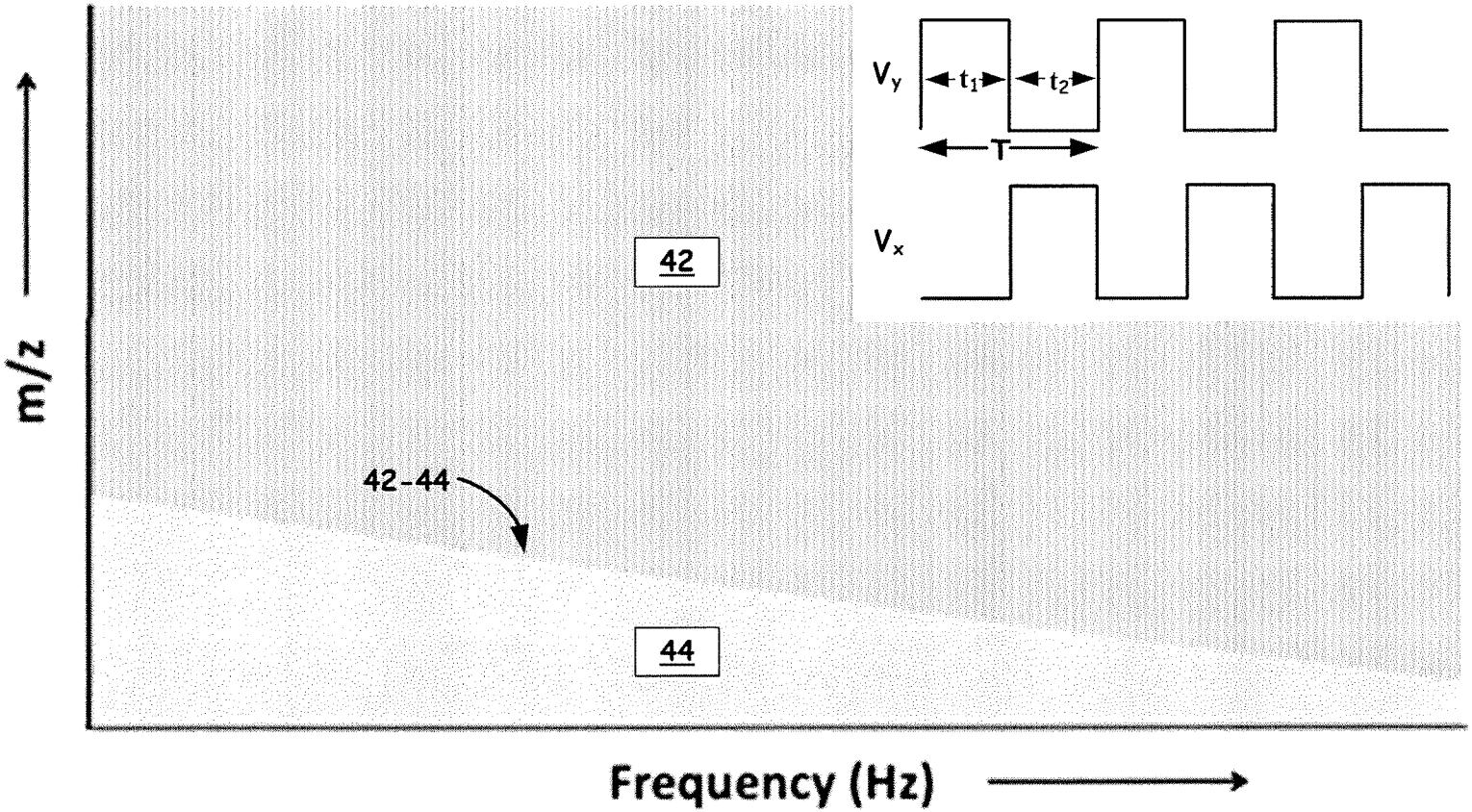
FIG. 4 illustrates a digital waveform duty cycle of the present invention.

FIG. 4 illustrates such a concept. To explain, normally digital ion guides are operated with a 50% waveform duty cycle ($t_1=t_2$), T being the Periodic Time, (T), $V_y$ and $V_x$ being the DC voltage amplitudes. For a given frequency, the values of m/z denoted by the reference character 42 are stable and will remain trapped while values in the region denoted by the reference character 44 are unstable. Accordingly, all m/z values above the 42-44 border are considered stable.

In more detail, FIG. 5A, FIG. 5B, FIG. 5C, and FIG. 5D illustrate the method herein of how changing the duty cycle narrows the range of stable values of m/z (42) for a given frequency equivalent to creating a net DC potential between the rod sets.

Figure 5B:
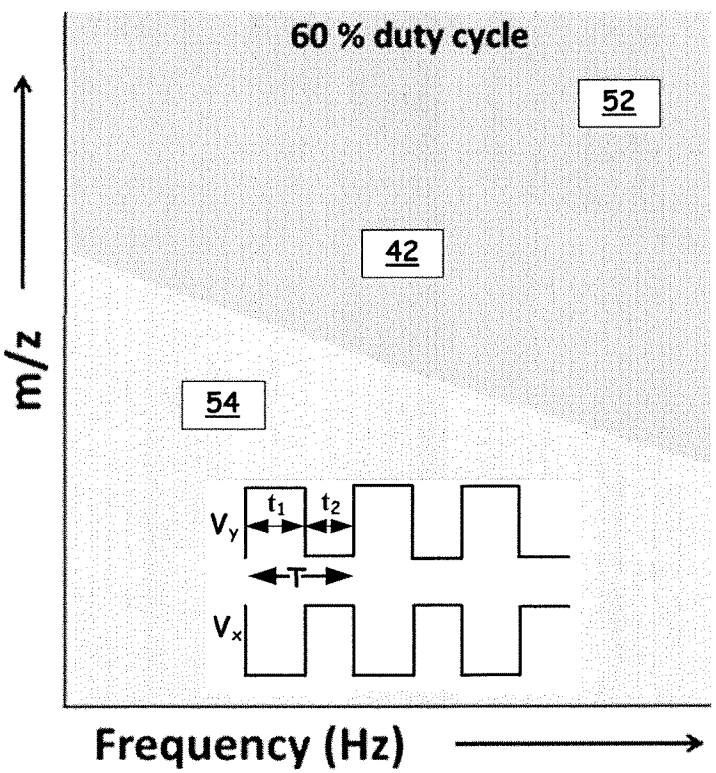
FIG. 5B illustrates a 60% duty cycle as compared to the 50% digital waveform duty cycle of FIG. 5A and corresponding stability regions.
Figure 5A:
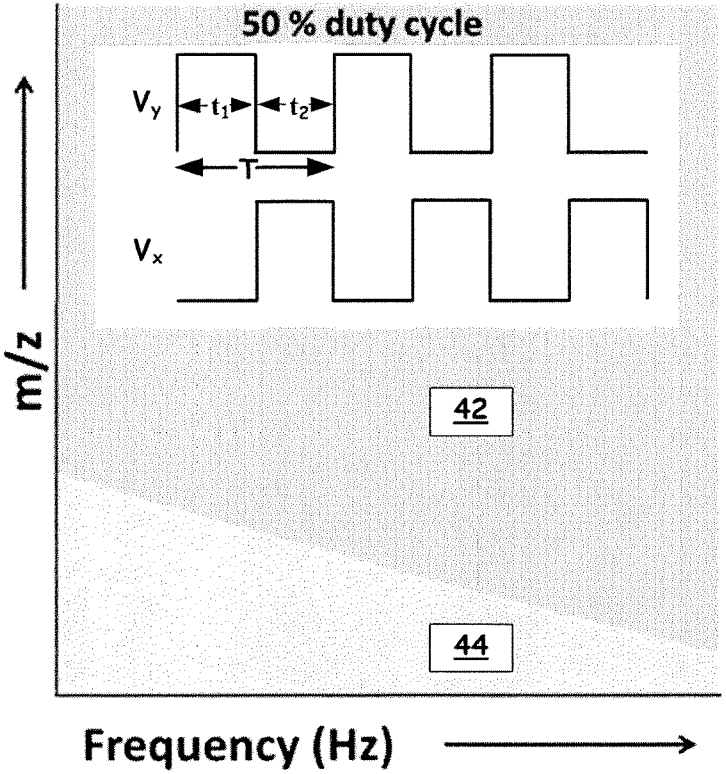
FIG. 5A illustrates a 50% digital waveform duty cycle.

Thus, FIG. 5A shows a 50% duty cycle (FIG. 4 reproduced for convenience) and FIG. 5B shows a 60% duty cycle. As before, reference character 42 indicates the stable region but now with reference character 52 indicating a region along the x-axis and unstable along the y-axis. Reference character 54 by contrast indicates a stable region along the y-axis and unstable along the x-axis. It is to be noted that % duty cycle=$(t_1/T)\times100$, with T being the Periodic Time (T).

Figure 5D:
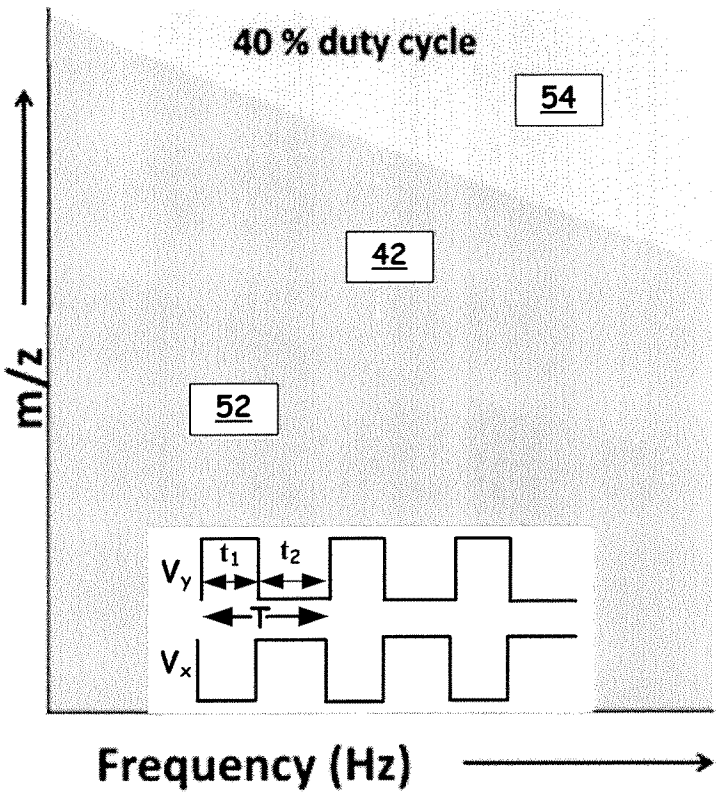
FIG. 5D illustrates the 40% duty cycle as compared to the 60% digital waveform duty cycle of FIG. 5C and corresponding stability regions.
Figure 5C:
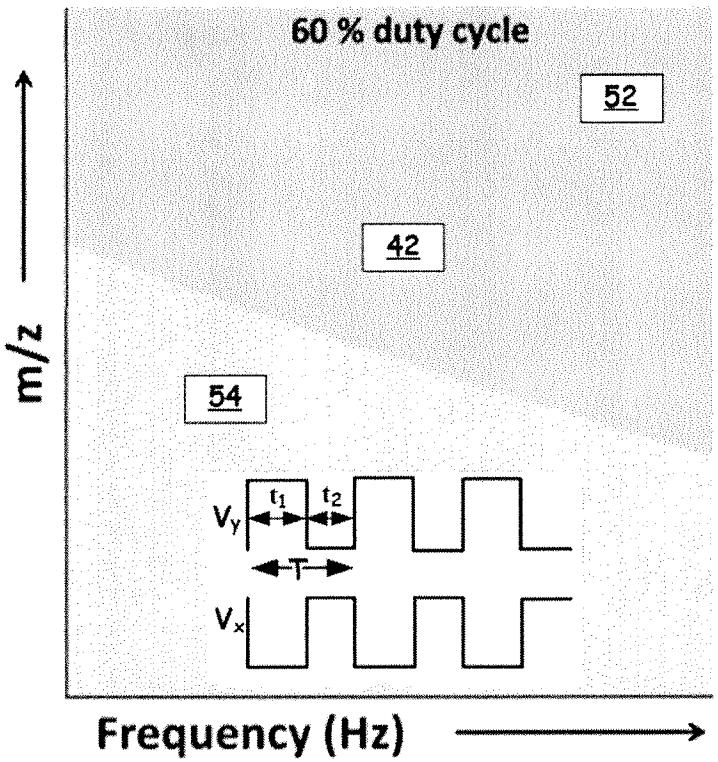
FIG. 5C illustrates the same 60% duty cycle as compared to the 40% digital waveform duty cycle of FIG. 5D and corresponding stability regions.

FIG. 5C shows the 60% duty cycle stability diagram of FIG. 5B compared to a 40% duty cycle stability diagram as shown in FIG. 5D and reference characters denoted as before. Note that an N % duty cycle is equivalent to a 100−N % duty cycle. It essentially switches $t_1$ and $t_2$ and thereby switches the x- and y-axis stabilities. The stability region denoted by reference character 42 is the same.

Figure 6:
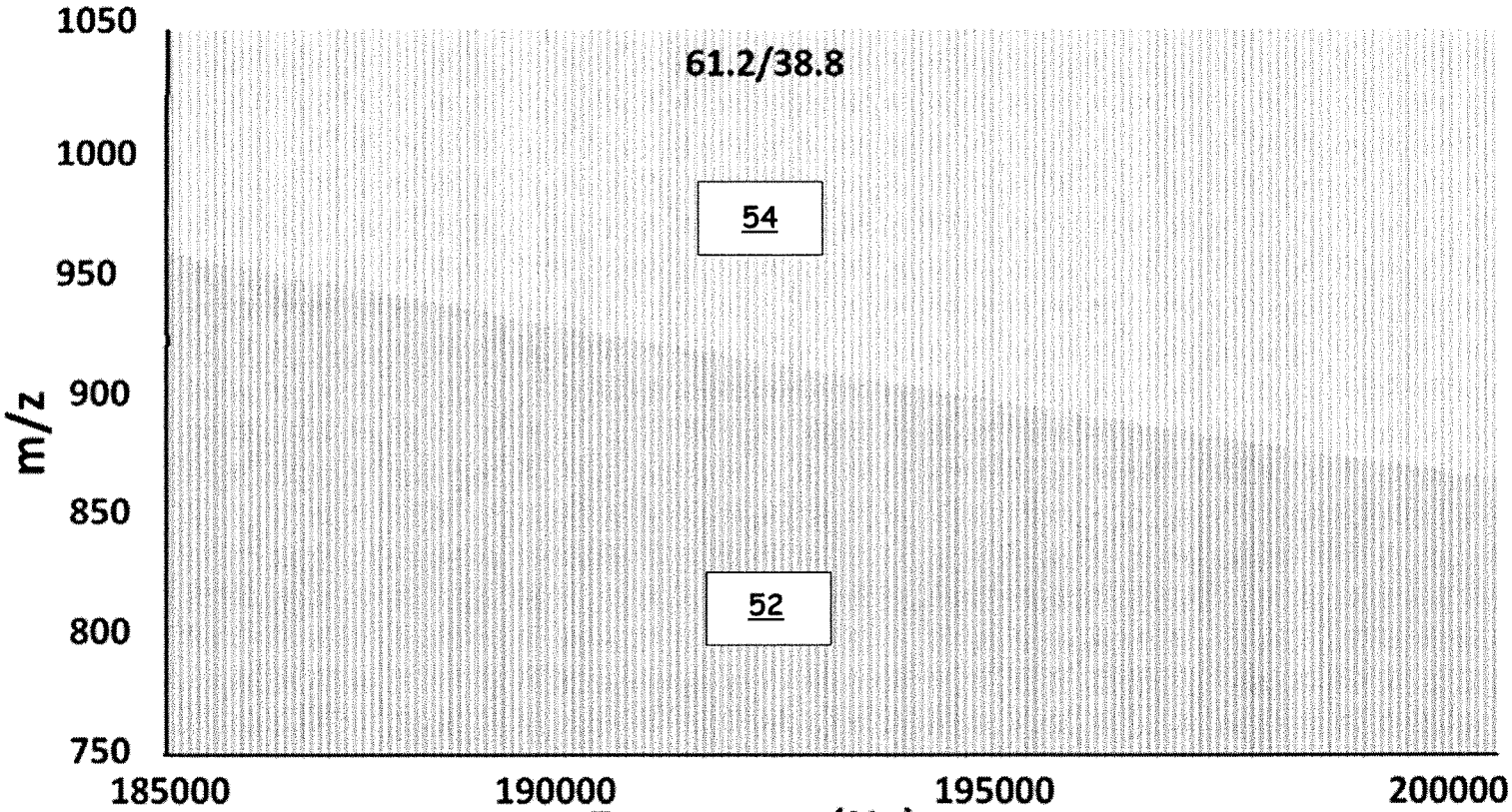
FIG. 6 illustrates the duty cycle being narrowed to allow only one nominal mass to be transmitted or trapped.

FIG. 6 illustrates an example embodiment wherein the duty cycle (i.e., denoted as 61.2/38.8) can be narrowed fine enough to allow only one nominal mass to be transmitted or trapped. However, isolating ions in this manner requires precise control of the waveform. Conventional waveform generators (WFG) do not provide enough control for unit mass isolation.

Figure 7B:
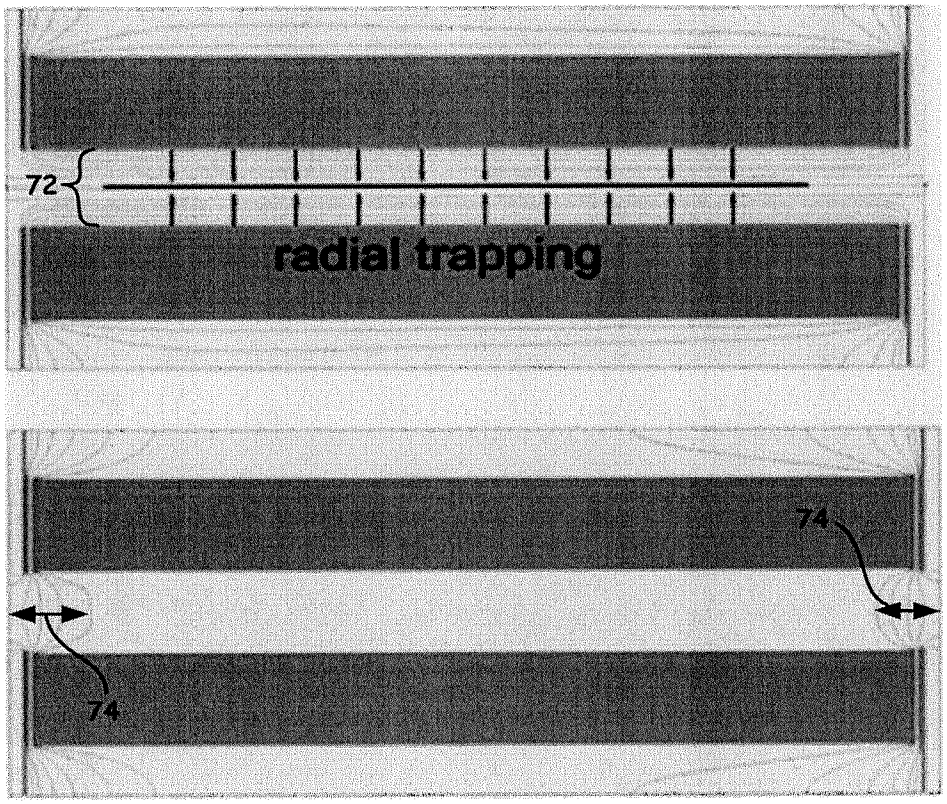
FIG. 7B shows waveform induced stresses wherein during $t_1$ and $t_3$ radial trapping is provided and during the $t_2$ portion of the waveform there is no radial force applied, but there is a potential between the rods and the end cap electrodes that creates an axial force near the end cap electrodes.
Figure 7A:
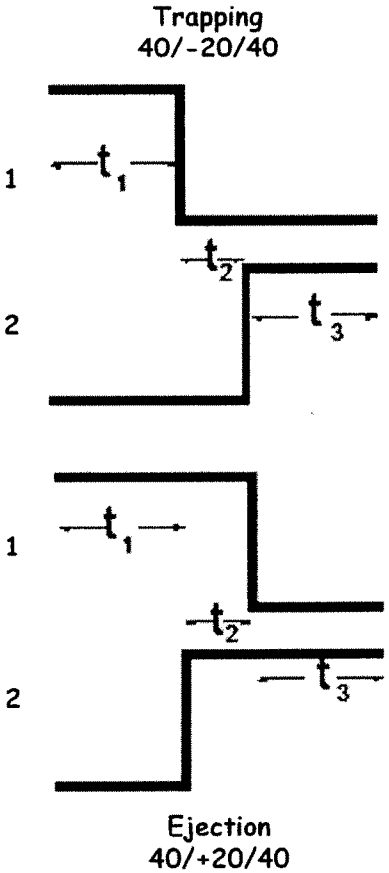
FIG. 7A illustrates waveform periods $t_1$, $t_2$ and $t_3$ that are utilized herein to manipulate trapping waveforms.

FIG. 7A illustrates an example embodiment to manipulate the trapping waveforms. Previously the rod set waveforms to perform mass filtering were inversions of each other. Different waveforms can also be created by shifting the phase. There are three periods that define the waveforms $t_1$, $t_2$ and $t_3$. The waveforms are mirror reflections that require $t_1=t_3$. There is a period $t_2$ where both sets have the same potential and the potential on the rods may be positive or negative during $t_2$. Specifically, to define and express the types ofwaveforms applied, a 3 term nomenclature has been adopted: $t_1/\pm t_2/t_3$, with $t_1$ the duration of the positive portion of the radial trapping field of waveform 1, $t_2$ is the portion of the waveform where both rod sets are at the same potential, as stated above, wherein a + sign indicates an axial ejection waveform and a − sign for trapping and $t_3$ is the duration of the positive portion of the radial trapping field of waveform 2, as shown in FIG. 7A. Note that the denoted top waveforms 1, 2, provide a 40/−20/40 trapping arrangement and the bottom waveforms 1, 2, provide a 40/+20/40 ejecting arrangement.

Figure 7D:
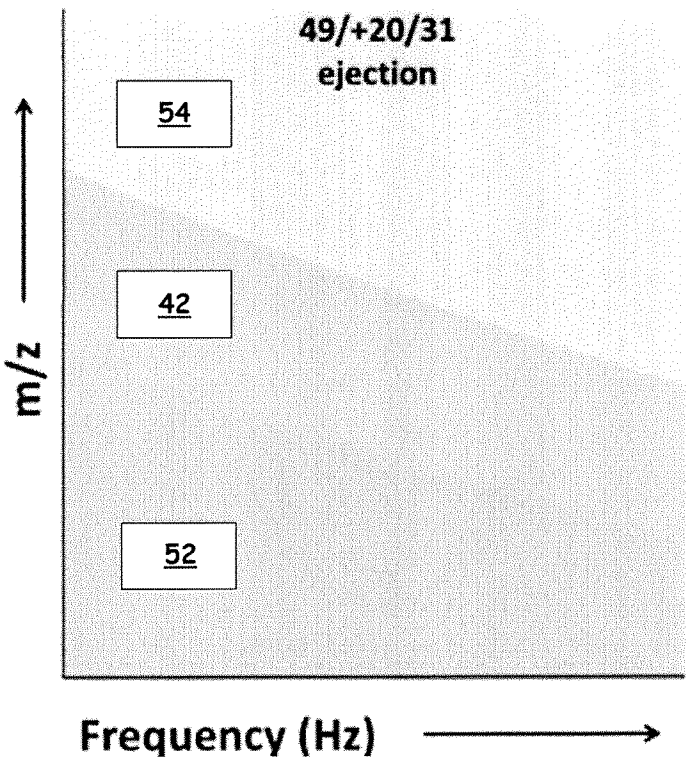
FIG. 7C and FIG. 7D. Illustrate $t_1/\pm t_2/t_3$ digital waveform manipulation to enable trapping or ejection of ions, i.e., wherein a + sign indicates an axial ejection waveform and a − sign for trapping.
Figure 7C:
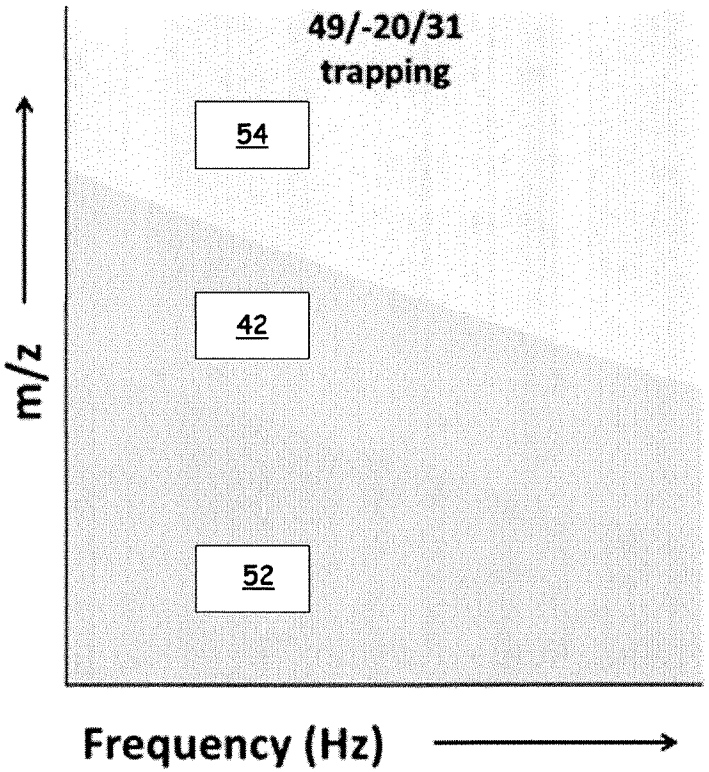

FIG. 7B illustrates breaking down waveform induced stresses. The equipotential contours during $t_1$ and $t_3$ provide radial trapping wherein the radial trapping forces are denoted by the reference character 72. During the $t_2$ portion of the waveform there is no radial force applied, but there is a potential 74 between the rods and the end cap electrodes that creates an axial force near the end cap electrodes. The force can be inward or outward depending on the sign of the sign of the potential FIGS. 7C and 7D further illustrates the utilization of the hereinbefore described $t_1/\pm t_2/t_3$ digital waveform manipulation to enable trapping or ejection of ions, i.e., wherein a + sign indicates an axial ejection waveform and a − sign for trapping. Specifically, it is to be noted that the stability region is the same when $t_1$ and $t_3$ are switched, only the directions of stability switch. There is no difference when an axial trapping or ejection field is applied. Axial ejection potentials have the same radial stability diagram as the axial trapping potential; however the differentiation is by sign, as started above. For example, in FIG. 7C (49/−20/31) provides trapping while the plot of FIG. 7D (49/+20/31) provides ejecting of desired ions.

Figures 8A, 8B:
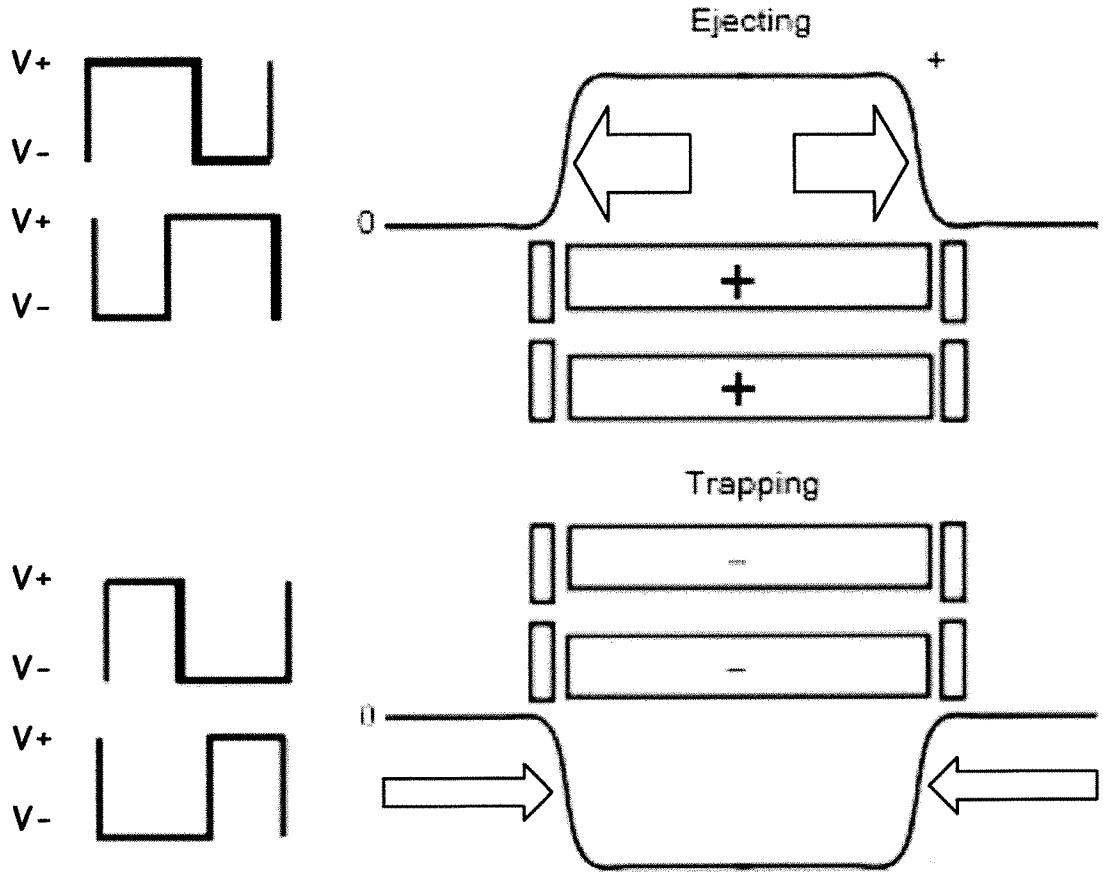
FIG. 8A illustrates a waveform wherein all the rods of the multipole are high for 20% of the time to provide ejecting.
FIG. 8B illustrates a waveform wherein all rods are low for 20% of the time to provide trapping.

FIG. 8A and FIG. 8B illustrate example non-limiting axial trapping and ejecting methods utilized herein. In particular, FIG. 8A illustrates a waveform wherein all the rods of the multipole are high for 20% of the time to provide ejecting while FIG. 8B illustrates a waveform wherein all rods are low for 20% of the time to provide trapping. Manipulating can for example provide instantaneous switching between axial trapping and ejecting with the beneficial aspect that switching does not affect radial stability. It is also to be noted that if $t_2=0$, there is no axial trapping while increasing $t_2$ increases the axial trapping force.

Figure 9B:
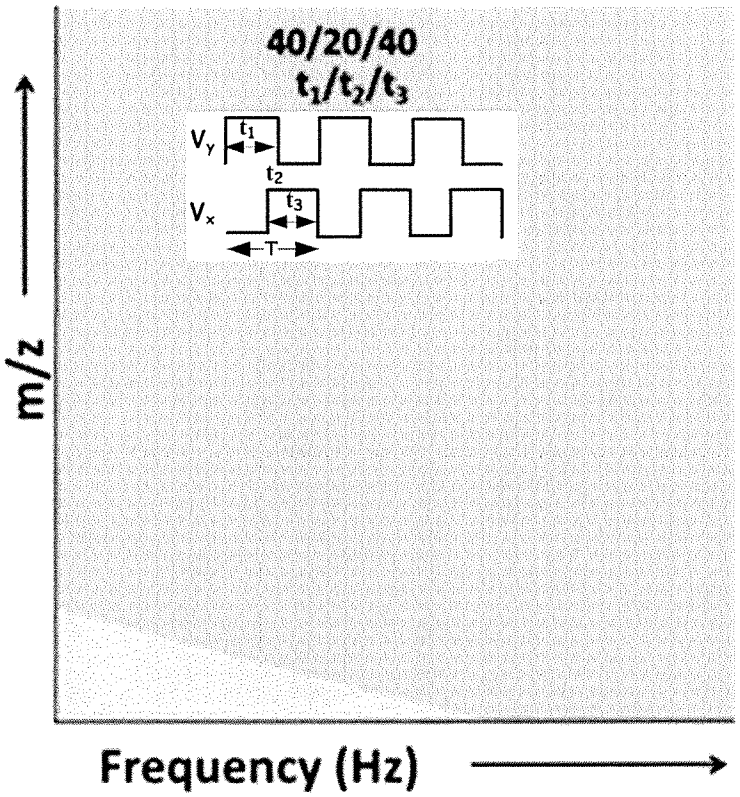
FIG. 9B shows an example 40/20/40 waveform durational manipulation as compared to the 50/0/50 waveform durational manipulation of FIG. 9A. Such an arrangement illustrates increasing the axial trapping/ejection component of the waveform so as to decrease the duration of the quadrupolar portion of the waveform and decrease the Low Mass Cut Off (LCMO).
Figure 9A:
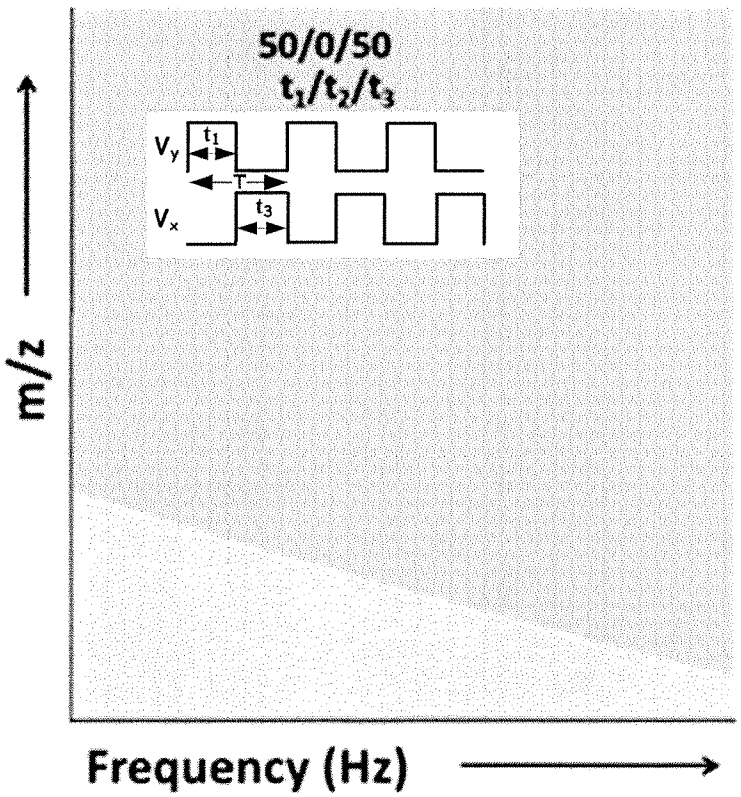
FIG. 9A shows an example 50/0/50 waveform durational manipulation as compared to the 40/20/40 waveform durational manipulation of FIG. 9B Such an arrangement illustrates increasing the axial trapping/ejection component of the waveform so as to decrease the duration of the quadrupolar portion of the waveform and decrease the Low Mass Cut Off (LCMO).

FIG. 9A (denoted as (50/0/50) and FIG. 9B (denoted as (40/20/40) show how increasing the axial trapping/ejection component of the waveform decreases the duration of the quadrupolar portion of the waveform and decreases the Low Mass Cut Off (LCMO). The radial stability is the same whether the rod potentials are positive or negative.

With respect to defining the radial stability, it is noted that the radial stability of the ions in a quadrupole can be determined by matrix solutions of the Hill equation, as known to those skilled in the art. The boundaries of stability are defined by the absolute value of the trace of the transmission matrix and the transmission matrix trace defines the stability for one direction (x or y) at a time. The stability of the ions in the device is defined by the superposition of the x and y stability results and when the duty cycle is changed the boundary conditions change.

Stability and Direction

Ions are stable when |Tr(M)|::: 2. This value is defined as a function of $f=4ezV/mro^2\Omega^2=czq_{xy}$, with V being the voltage, Z the charge, m mass (kg), ro device radius (m), radial frequency (radians/sec) being defined by $\Omega=2\pi F$, with F being the device frequency (Hz). When there is no net DC between the rod sets, the x-stability and y-stability traces overlap, such as, for example, for the 50% duty cycle case. When the duty cycle is changed the boundary conditions along x and y change. The range of stabilities along x and y narrow and shift with respect to f or q. They thus no longer completely overlap and where they overlap defines the region off or q that is stable. Because those in the field understand stability analysis with sinusoidal ion traps and guides, the tendency is to assume that the stability along the x and y axis are equivalent and it follows that the tendency is to plot stability in one direction only. This however, can be misleading as changing the duty cycle changes the duration of the applied fields and if the fields are not applied symmetrically the stabilities in different directions are not equivalent.

Figure 10:
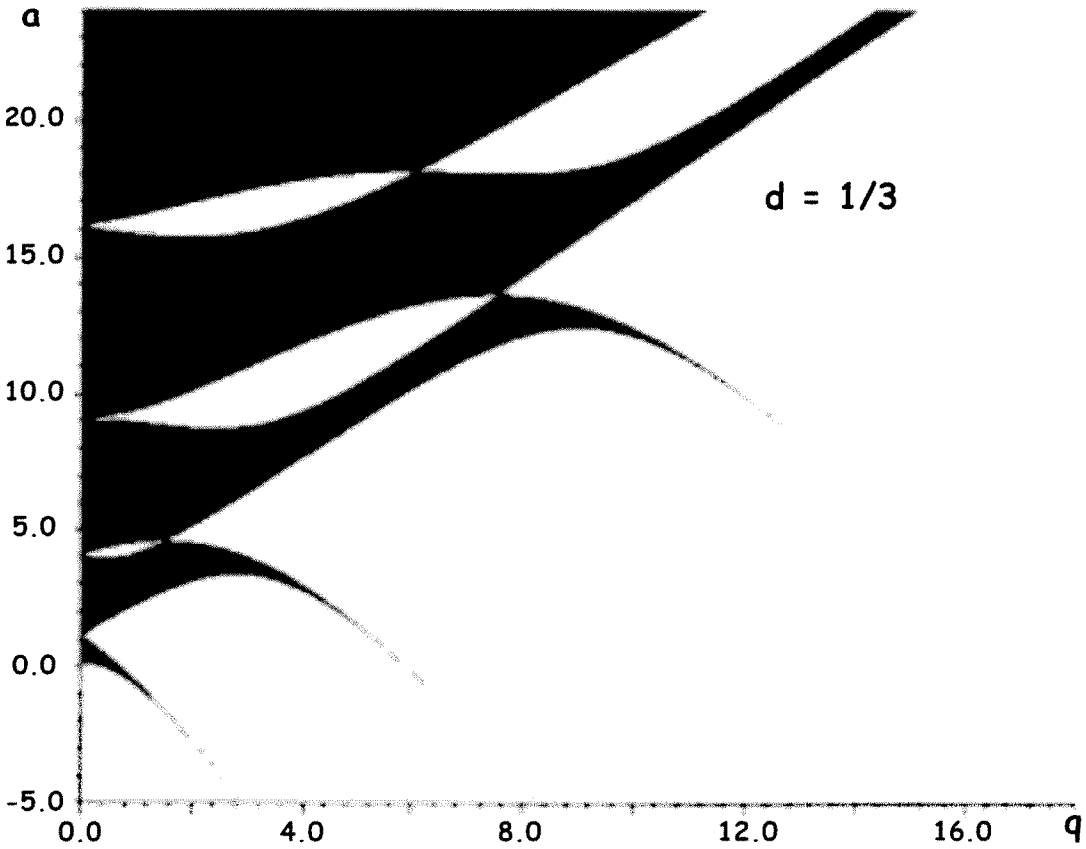
FIG. 10 shows a calculated plot for a stability diagram with a 33.33% duty cycle.

For example, FIG. 10 shows a calculated plot (Konenkov et al.) for a stability diagram with a 33.33% duty cycle. Analysis provided had stated that the black regions have stable ion motion. However, this is only true in one direction. The field in the orthogonal direction is different and that difference shifts or displaces the stability regions. Thus there is no overlap of these regions and there is no stable ion motion at ⅓ duty cycle.

Ion Excitation by Frequency Jumping after Ion Isolation.

It is to be noted that the duty cycle has to be changed to extend the range of product ions that can be trapped. The smaller the difference between $t_1$ and $t_3$, the greater the range. Frequency hopping in and out of the stability region producesexcitation. Controlling the number of cycles the ion experiences beyond the boundary permits control of the excitation. Frequency hopping to a point beyond the boundary and quickly back permits the parent and smaller product ions within the range of the down arrow to be stably trapped when they are created. Higher m/z product ions can also be analyzed by exciting in the low mass cut off region. Excitation can also be achieved by moving the boundary by switching the duty cycle. As also stated previously above, an additional novel embodiment is to move the boundary so that the ion is just inside the stable region. The proximity of the boundary translationally excites the ions while maintaining stability. The ions can be held at that point for a desired timeframe, e.g., 100's of milliseconds while the dissociation process proceeds to completion.

The present invention will be more fully understood by reference to the following examples, which are intended to be illustrative of the present invention, but not limiting thereof.

EXAMPLES

Electrosprayed reserpine, which has a mass at m/z 609.69 (MH) was the target molecule to illustrate the workings of the embodiments disclosed herein. The range of stability diagrams shown herein was selected by the generation of MS/MS from this mass. Shifting the trapping range to essentially any value is a minor procedure. The LRQ was operated at ±200 V and a duty cycle of 47/6/47

$$\left(\frac{t_1 100}{T} \Big/ \frac{t_2 100}{T} \Big/ \frac{t_3 100}{T}\right).$$

Figure 11C:
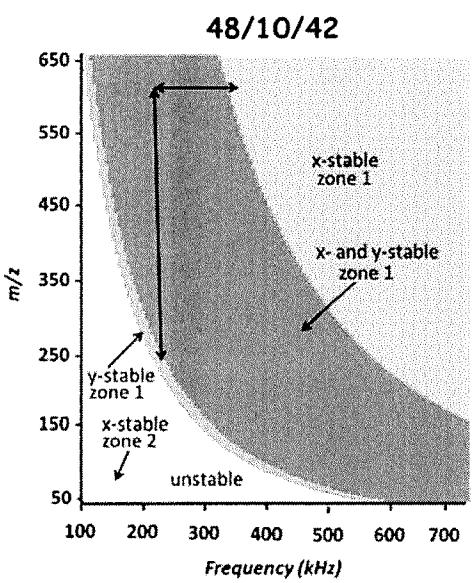
FIG. 11C illustrates the m/z versus frequency stability diagram when the duty cycle is switched to a 48/10/42 waveform to introduce a high mass cutoff and a wide range of stable m/z.
Figure 11B:
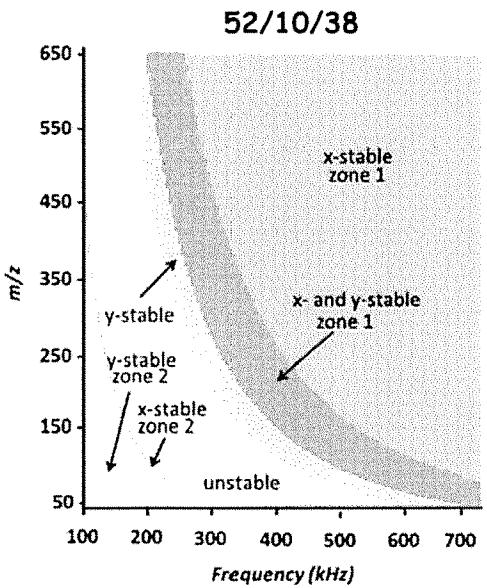
FIG. 11B illustrates the m/z versus frequency stability diagram for the 52/10/38 waveform so as to illustrate ion isolation while maintaining axial trapping when changing the duty cycle.
Figure 11A:
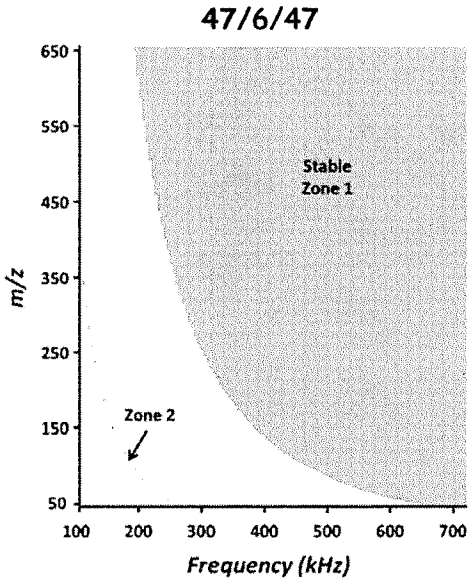
FIG. 11A illustrates an m/z vs F Stability diagram for a 47/6/47 duty cycle waveform that was utilized to illustrate the working embodiments of the application.

FIG. 11A illustrates the m/z versus frequency stability diagram for the 47/6/47 waveform. The dark gray shaded regions are stable. The white regions are unstable. This waveform provides an illustration of a symmetric quadrupole field ($t_1=t_3$) with an axial well depth of 12 V ($D_{axial}=zV^{-}\cdot t_2/T$) when the end cap electrodes are at ground potential. The value z defines the ion charge. If the inlet is left at ground potential, this waveform can be used to trap the reserpine ions with minimal fragmentation. Fragmentation can be induced by increasing the value of $$\frac{t_2 100}{T}.$$

This changes the collision energy of the ions entering the gas filled (5 mTorr) LRQ by $E_{col}=zV^{-}\cdot t_2/T$ assuming the inlet is at ground potential. The m/z vs F stability diagram was calculated from matrix methods known and understood by those skilled in the art.

FIG. 11B illustrates the m/z versus frequency stability diagram for the 52/10/38 waveform so as to illustrate ion isolation while maintaining axial trapping as accomplished in the LRQ when changing the duty cycle. It is to be noted in FIG. 11B that the dark gray shaded regions are stable, the white regions are unstable, and the lighter gray tones are only stable along one axis. It is also to be noted that the dark gray stability region has narrowed because $t_1 \neq t_3$ while maintaining the ability to axially trap or eject ions because $t_2 \neq 0$.

The diagram of FIG. 11B thus shows that the range of stable frequencies for the m/z 609.69 ions is approximately 202.5 to 265.0 kHz. Standard function generators have 1 Hz frequency resolution or better. The frequency can be jumped to the extremes of the stability range to eliminate the ions above and below the m/z of interest to perform precise ion isolation. The isolated ions can be fragmented by ejecting them into the second gas filled digitally operated small radius quadrupole (SRQ) 16, as discussed above and as shown and in FIG. 3. The collision energy is controlled by using the duty cycle of the LRQ to control the energy of ejection $$\left(KE_{eject} = zV_{LRQ}^{+} \cdot \frac{t_2}{T}\right)$$

or by using the duty cycle of the SRQ to control the axial well depth $$\left(D_{SRQ} = zV_{SRQ}^{+} \cdot \frac{t_2}{T}\right))$$

or a combination of the two $$KE_{collison} = zV_{LRQ}^{+}\left(\frac{t_2}{T}\right)_{LRQ} + zV_{SRQ}^{-}\left(\frac{t_2}{T}\right)_{SRQ}.$$

If one were to limit the values of $$\frac{t_2}{T}$$

to 0.5 for each quadrupole operating at ±200 V, the ion beam energy maximizes at about 200 V/z. The ability to control the collision energy with up to z·200 eV is more than sufficient for collision induced dissociation (CID). The exit end cap of the SRQ can be biased if needed to enhance axial trapping well depth. However, leaving it at ground potential is usually sufficient. The fragmented ions settle at a point just before the exit end cap where the axial forces from the biased slanted wire electrodes and the duty cycle induced axial trapping potential balance to await axial ejection into the oa-TOF-MS.

An alternative method for performing CID can also be done inside a single linear quadrupole following the trapping and isolation procedure described above. FIG. 11C reveals the stability diagram created when the duty cycle is adjusted to 48/10/42. The difference between $t_1$ and $t_3$ has been reduced to broaden the range of fragment ions (again see FIG. 11C). Keeping the $t_2$ at 10% will maintain a sufficient axial well depth ($D_{axial}=zV^{-}\cdot t_2/T$) of 20V (z=1). Under these conditions, the $MH^{+}$ reserpine ions are stable in the SRQ from approximately 195.2 to 410.8 kHz.

In order to collisionally induce dissociation the translational kinetic energy of the ion has to be increased. When an ion crosses into an unstable region, it quickly absorbs energy from the applied quadrupole field to eject when its kinetic energy exceeds the trapping well depth. Fortunately, that process takes multiple cycles of the trapping waveform. Moreover, the waveform generator is agile enough to apply a controlled number of cycles before switching the frequency back to a stable frequency (see the double headed horizontal arrow in FIG. 11C). Collisions with the buffer gas convert the ions' kinetic energy to internal energy to induce fragmentation. Note that the starting frequency is not near the edge of the stability zone so that the ions are not significantly excited by proximity to the boundary. The range of fragmented ions collected is defined by the projection of the vertical double headed arrow on to the y-axis. This CID process can be repeated until the desired level of dissociation is complete. The isolation and CID processes may be performed on any product ion species to provide $MS^{n}$ in a single linear ion guide.

Alternatively, the frequency can remain constant during the process and excitation can be induced by changing the duty cycle. For example, ions could be trapped with the duty cycle whose stability diagram is depicted in FIG. 11A. Then the shape of the stability region is changed, as shown in FIG. 11C, by switching the duty cycle so that the target ions are no longer stable at the fixed frequency. That unstable waveform is then applied for n cycles to translationally excite the ions after which the duty cycle is switched back to the stable waveform FIG. 11A while the translational energy of the ions is converted to internal energy through buffer gas collisions to induce dissociation. Duty cycle switching and frequency hopping can be used to destabilize the ions and yield the same type of quadrupole field induced excitation.

A more subtle example approach is to use the $\beta=0$ (frequency of oscillations in the x- and y-directions) boundary of the stability region to induce excitation. In such an arrangement, the duty cycle is switched to introduce a high mass cutoff and a wide range of stable m/z as depicted in FIG. 11C. The frequency is then shifted to place the ions just inside the stable region. As the changing frequency moves the ions toward the stability boundary, the amplitude of their stable, periodic secular oscillation increases. Once the boundary is reached, the ion oscillations become periodic but unstable. Ions just inside the boundary have the maximum allowable translational kinetic energy without detrapping. The oscillating quadrupolar field maintains this high level of translational kinetic energy while the ions undergo buffer gas collisions that increase their internal energy until they dissociate. The fragment ions are quickly cooled by collisions because they are farther from the boundary. In this way, the excitation can be applied for long periods of time (hundreds of milliseconds) without loss of the precursor ions because they are never unstable.

Experimental Results

Accordingly, electrosprayed reserpine ions were introduced into the inlet shown in FIG. 3 where they are pass through the LRQ 14 and then into the SRQ 16 to be trapped and collected for on demand injection into the pusher of the oa-TOF-MS 17. The potentials of the DC power supplies that are switched by the high voltage pulsers (DEI, Inc, PVX-4150, Colorado) to create the LRQ waveforms were + and −250 V. The duty cycle of the LRQ was set to 45/10/45. Because the inlet is grounded, the change in axis potential is −25 V. The LRQ entrance end cap electrode was set to −10 V. The potentials of the DC power supplies that are switched by the pulsers to create the SRQ waveforms were + and −150 V. The potential of the end cap electrode between the LRQ and SRQ was set to −27 V. The duty cycle of the SRQ was initially set to 40/20/40 yielding a DC axis potential of −30 V. Under these conditions the ions pass directly through the LRQ and into the SRQ to be trapped and collected near the grounded exit cap electrode. The trapped ions were ejected from the SRQ into the oa-TOF for on demand mass analysis with a 45/10/45 ejection duty cycle the created a DC axis voltage of +15 V. That yielded a 15 V potential drop into the oa-TOF.

Figure 12A:
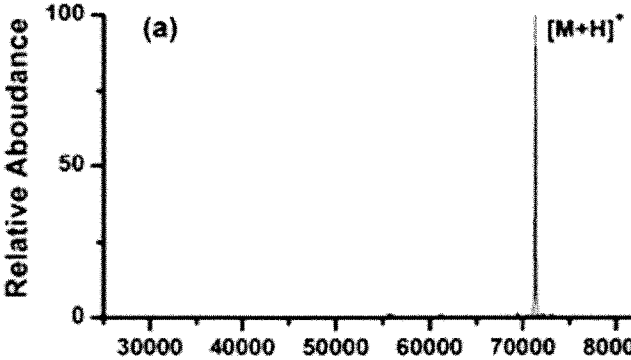
FIG. 12A illustrates an example Tandem mass spectroscopy spectrum of reserpine ion after isolation in a small radius quadrupole, as disclosed herein.

FIG. 12A reveals the results of the mass spectrum (i.e., using Tandem Mass spectroscopy) of singly charged reserpine after it has transferred to the SQR 16 initially operating with a trapping 40/20/40 duty cycle. The combination of the duty cycle and the high voltage potentials of the applied rectangular waveforms yield a net −30 V potential drop between the inlet and the SRQ.

Figure 12B:
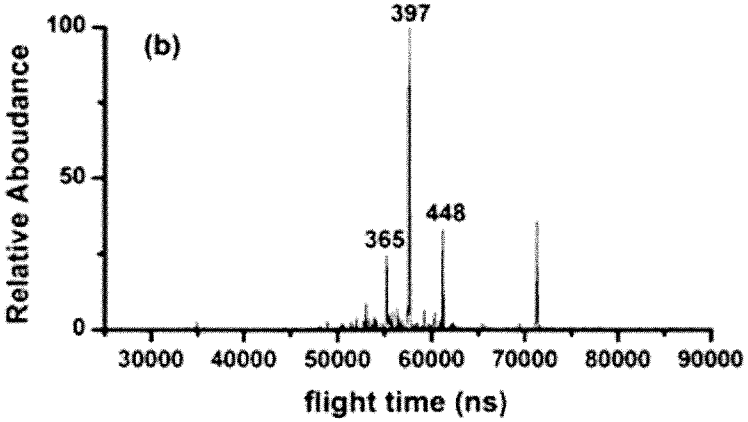
FIG. 12B illustrates an example Tandem mass spectroscopy product ion spectrum of reserpine by varying trapping duty cycle of the SRQ.

As evidenced in FIG. 12A the applied potential changes were not enough to yield significant fragmentation. The $t_2$ value of SRQ trapping duty cycle was then increased while keeping $t_1=t_3$ to increase the potential drop between the inlet and the SRQ. A −36 V duty cycle induced potential drop (38/24/38) between the inlet and the SRQ and the same ion collection and ejection procedure used in FIG. 12A was used to produce the MS/MS spectrum in FIG. 12B. The ion transfer through the LRQ 14 and into the SRQ 16, as shown in FIG. 3, is prompt because the LRQ 14 was not setup to trap the ions. Therefore, the net potential drop between the inlet and the SRQ defines the collision energy. Using the duty cycle to decrease the DC axis potential of the SRQ by only 6 V was enough to produce the observed fragmentation. The duty cycle induced axial fragmentation procedure revealed here can be as easily performed between the inlet and a single quadrupole or it can be performed with each transfer into a quadrupole if the quadrupoles are used to trap the ions. This is the type of MS/MS procedure that one may use with the rapid throughput of a Q-TOF with the novel aspect that the sampling duty cycle into the mass analyzer is always substantially near unity.

Figure 13B:
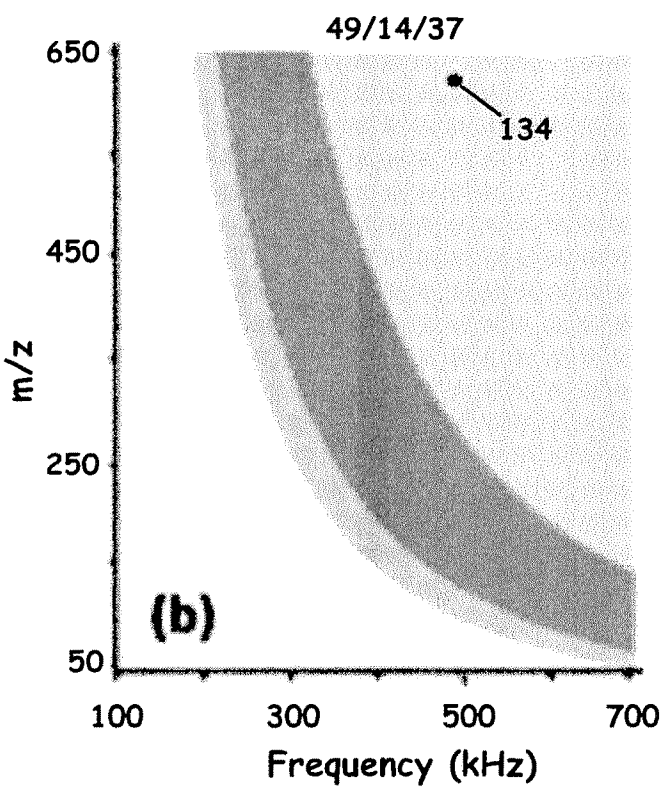
FIG. 13B shows a 49/14/37 duty cycle at 500 kHz plot used to illustrate quadrupole waveform induced radial excitation and $MS^n$, wherein the ions are out of the stability region for 10 μs (5 cycles) and then switched back to the 40/20/40 waveform as used to provide FIG. 13A where the ions are inside the stability boundary for 100 μs.
Figure 13A:
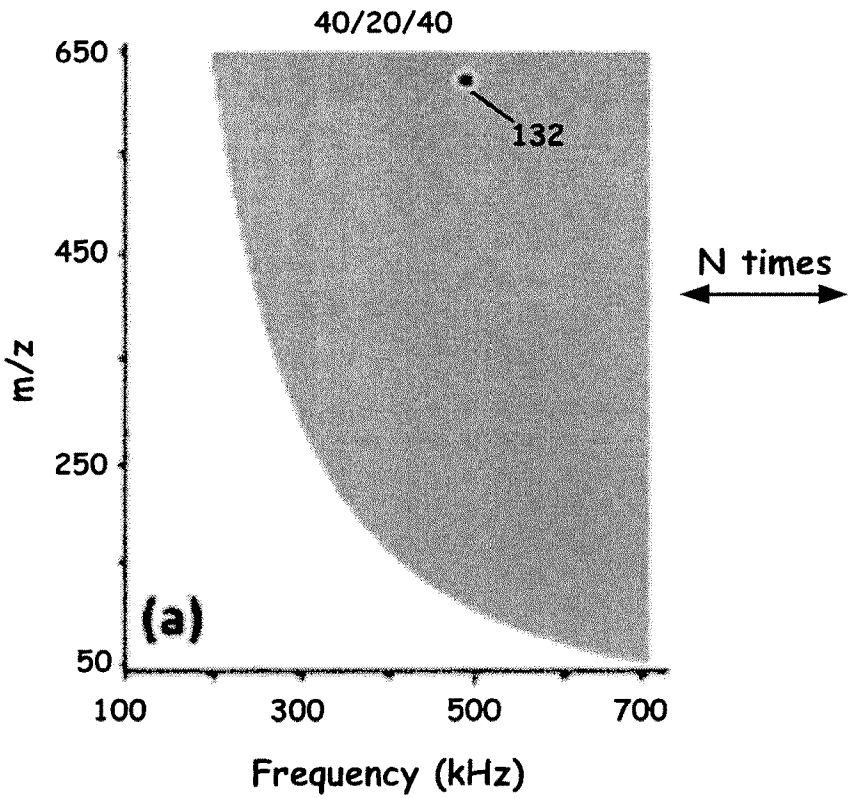
FIG. 13A shows a 40/20/40 duty cycle at 500 kHz plot used to illustrate quadrupole waveform induced radial excitation and $MS^n$.
Figure 13C:
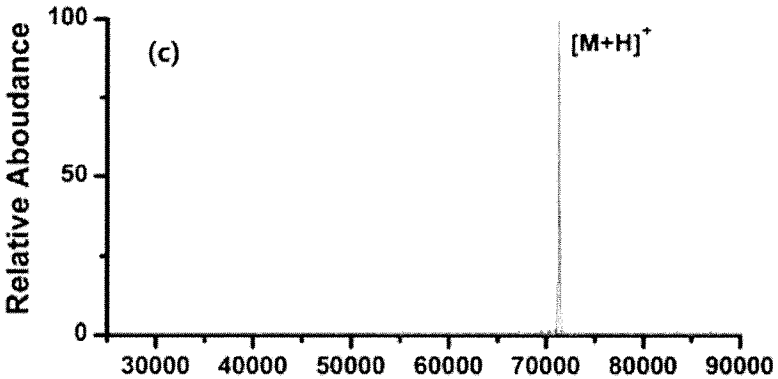
FIG. 13C shows a mass spectrum of reserpine after 40/20/40 duty cycle trapping but without duty cycle induced radial instability.
Figure 13D:
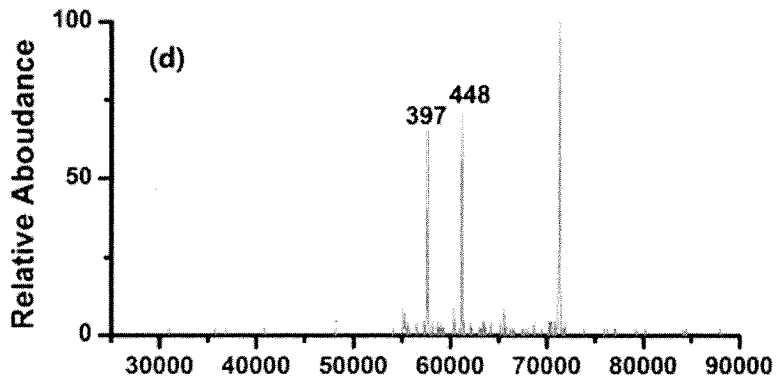
FIG. 13D illustrates an MS/MS collision-induced-dissociation (CID) spectrum of reserpine induced by switching the duty cycle to radially destabilize the reserpine ions for ~10 is (5 cycles at 500 kHz) and then switching the duty cycle back to restabilize the ions and allow them to undergo CID for 100 μs. Such a process was repeated 10 times to produce the spectrum.

FIG. 13A, FIG. 13B, FIG. 13C, and FIG. 13D further illustrate quadrupole waveform induced radial excitation and MS″ via the novel techniques disclosed herein. The reserpine ions were again isolated in the SRQ 16, as shown in FIG. 3, and collected at the end of the quadrupole using the same method previously illustrated. The trapping waveform was then set to 40/20/40 duty cycle at 500 kHz. Under these conditions, the reserpine ions are stable (e.g., 132) as shown in the stability diagram of FIG. 13A. The duty cycle was then switched to 49/14/37, as shown by the stability diagram of FIG. 13B where the ions (e.g., 134) are out of the stability region for 10 μs (5 cycles) and then switched back to 40/20/40 where the ions are inside the stability boundary for 100 μs. The process of duty cycle hopping of the waveform at fixed frequency was repeated 10 times (e.g., n times) to radially excite the reserpine ions and cause CID. The mass spectrum of reserpine after 40/20/40 duty cycle trapping but without duty cycle induced radial instability is shown in FIG. 13C. The duty cycle hopping induced MS/MS spectrum of reserpine is shown in FIG. 13C.

Alternatively, after the trapping and isolation is complete, the frequency could have been jumped to approximately 300 kHz and then the duty cycle shifted to 49/14/47, as shown in FIG. 13B. Then the frequency could be jumped to 500 kHz for 5 cycles to excite the ions and jumped back to for 50 cycles to undergo CID. This process would yield an MS/MS spectrum identical to the one shown in FIG. 13D because the excitation processes are equivalent.

Figures 14A, 14B:
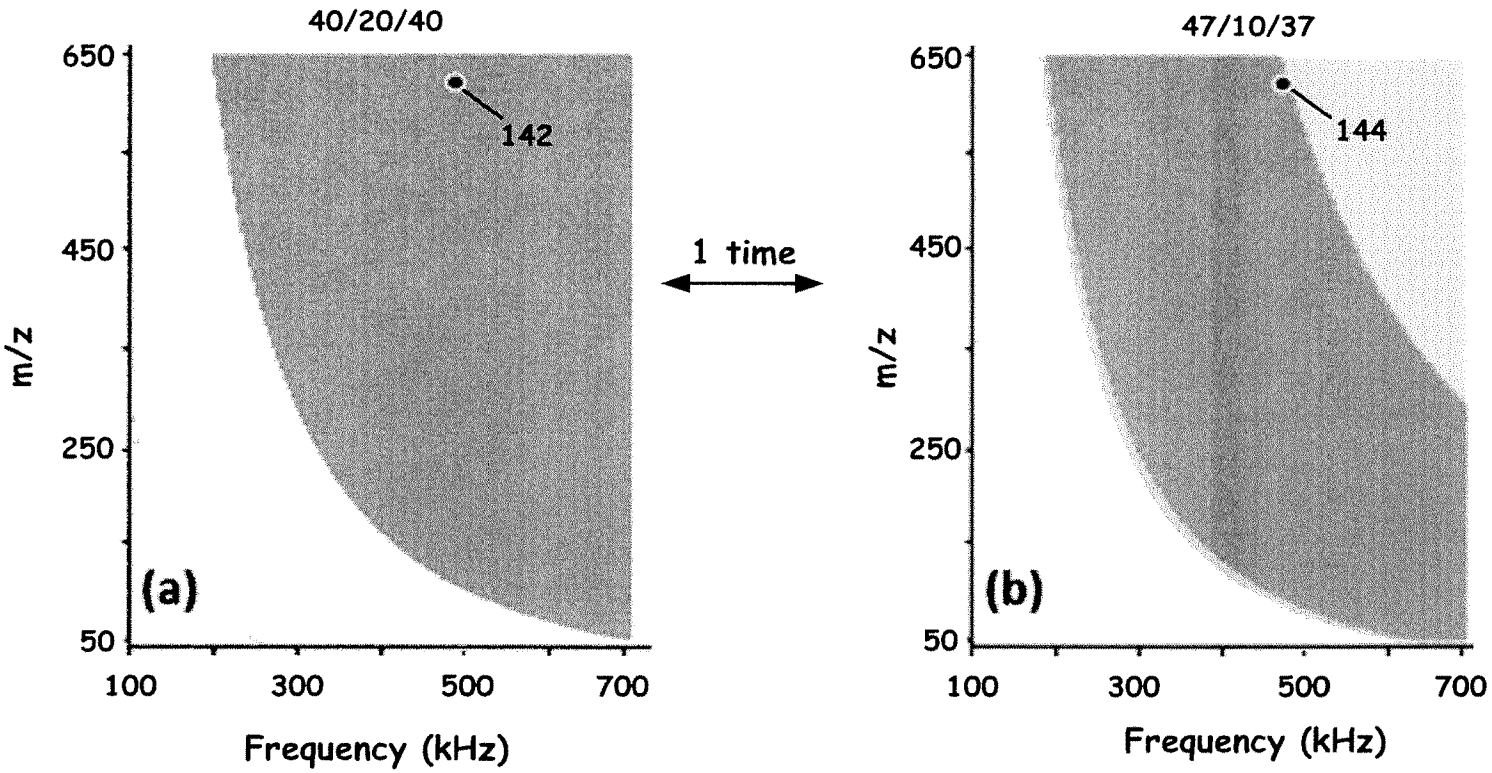
FIG. 14A shows a 40/20/40 duty cycle at 500 kHz plot used to illustrate quadrupole waveform induced radial excitation and $MS^n$.
FIG. 14B shows a 47/10/43 duty cycle stability diagram used for radial excitation of reserpine ion at 500 kHz at the boundary.
Figure 14C:
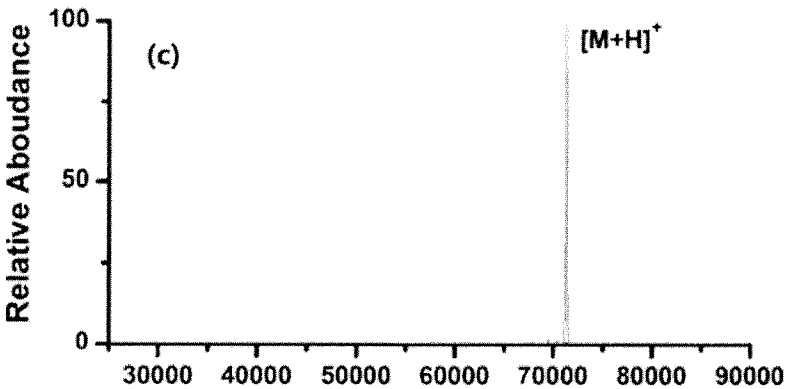
FIG. 14C shows a mass spectrum of reserpine after 40/20/40 duty cycle trapping but without duty cycle induced radial instability.
Figure 14D:
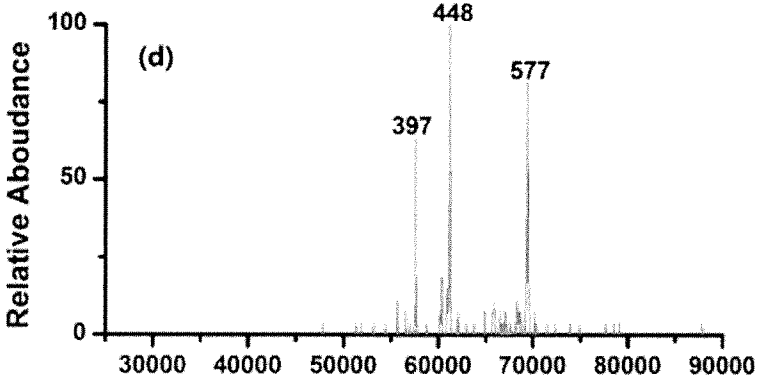
FIG. 14D illustrates an MS/MS collision-induced-dissociation (CID) spectrum of reserpine induced by switching the duty cycle to radially destabilize the reserpine ions for ~100 ms at 500 kHz and then switching the duty cycle back to restabilize the ions and allow them to cool for X μs before injecting them into the time-of-flight mass spectrometer (TOF).

Boundary induced CID is also easily accomplished by a procedure that is similar to duty cycle induced destabilization. The setup is the same that was sued to provide the results shown above. The difference is the method of radial excitation. Once again the frequency is held constant at 500 kHz with the reserpine ions 142 in a stable region, as shown in FIG. 14A and the duty cycle is changed to 47/10/43 to move the stability boundary near the reserpine ions 144 without moving them into the unstable region, as shown in FIG. 14B. In this case the reserpine ions remain stable, but because they are near the boundary they are radially excited, though not enough to detrap. Because they cannot be ejected by this procedure, the excitation can be sustained for long periods. Any fragments are stabilized away from the boundary. The mass spectrum of reserpine after 40/20/40 duty cycle trapping but without duty cycle induced radial instability is again shown for convenience in FIG. 14C. In any event, the procedure was applied for 100 ms to completely fragment the reserpine ions, as shown in FIG. 14D. Surprisingly, this procedure appears to be gentler than the procedures that destabilize the ion for short periods because of the presence of the m/z 577 ions that are not present in any of the other methods of excitation.

Accordingly, results show that digitally driven linear ion guides can be operated as ion traps and perform MS/MS by controlling the change in the DC axis potential in moving the ion into a gas filled quadrupole (collision cell) in a similar manner to that used by standard Q-TOFs. The difference in this case is that waveform duty cycle instead of a separate power supply is used to create the DC axis potential change to energize the ions as they pass into a collision cell. Duty cycle based manipulation of the DC axis potential simplifies the hardware (fewer power supplies) while adding agility because the waveform response is essentially instantaneous.

The embodiments and discussion herein demonstrate that MS/MS can be performed in a single quadrupole by digital manipulation of the trapping waveforms. Disclosed stability diagram calculations show that manipulation of the duty cycle can be used to create a high mass boundary and narrow the range of stable masses. It is also disclosed herein that translating the ions from the stable zone into the unstable region for short periods (a few trapping waveform cycles) and then back can be used to induce CID.

Translation of the ions into the unstable region can be obtained by hopping the trapping frequency to move the ions into the unstable region or it can be accomplished by using the duty cycle to move the boundary so that the ion is no longer stable at the applied frequency. Both methods are essentially equivalent. The short sojourn into the region of instability allows the ions to rapidly absorb energy from the applied quadrupolar field. The duration of the jump into the unstable region is limited to a fixed number of cycles so that the ions will translationally excite without leaving the vicinity of the central axis of the quadrupole. The frequency/duty cycle is then jumped back into the stable region for n cycles to allow the field induced translational energy to be converted to internal energy through collisions with the buffer gas.

The novel benefits of this technique is that it permits broadband excitation, and the ions do not need to be collected at a single point so the large ion capacity of the linear trap can be fully utilized. On the other hand, boundary induced CID is best performed when the ions are collected at a single point along the quadrupole axis and is handy for exciting only a narrow range of masses. The benefit of this method of inducing CID is that it is easy to push it to completion without worrying about the duration of the excitation inducing ion loss.

A very important and beneficial aspect of digitally over sinusoidally driven devices is that there is no mass range limitation. The mass limitation of sinusoidal devices results from the use of resonantly tuned circuits to create the waveform and vary amplitude. Resonantly tuned circuits require fixed frequencies. The ability to vary the trapping frequency allows the trapping range to be move to any desired value. Consequently, digital production of the waveforms extends the mass range of the Q-TOF. Moreover, duty cycle manipulation of digitally produced waveforms is part of the desired technology that enables ultra-high mass ions ($m/z>20,000$) to be trapped, manipulated and mass analyzed with high resolution.

Accordingly, digitally driven linear ion traps to yield an instrument with all the benefits of linear ion guides and 3D ion traps without their respective undesirable characteristics. For example, unlike in 3D ion traps, the ions a digital linear quad do not have to traverse an RF barrier to enter the quadrupolar region; therefore, the trapping efficiency is much higher. Unlike the sinusoidally driven quadrupoles used in commercial Q-TOFs, digitally driven quadrupoles can trap and collect ions to preconcentrate them before mass analysis; therefore, the sampling duty cycle can be set near unity.

Additionally, quadrupole mass filter resolution is geometrically limited by the variation in the radius $r_0$ along the length of the device. Variations in $r_0$ along the entire length of the device result in variations in the range of stable masses. Ions must traverse the length of the quad to be detected. This does not have to happen in a linear quadrupole ion guide when it is used as a digitally operated ion trap. In this case, the ions can be collected in a compact cloud before the end cap electrode where mass isolation and CID can occur. The value of $r_0$ does not change appreciably over the tiny length of the ion packet. Therefore, digital operation of a linear guide as an ion trap does not have the same geometric limitations on mass resolution that occur when they are operated as mass filters. Moreover, mass isolation by digital waveform manipulation yields much better resolution than operating the quadrupole as a mass filter because the trapping frequency control is much more precise (up to 48 bit with direct digital synthesis) than adjusting the ratio of the AC and DC voltages.

It is to be understood that features described with regard to the various embodiments herein may be mixed and matched in any combination without departing from the spirit and scope of the invention. Although different selected embodiments have been illustrated and described in detail, it is to be appreciated that they are exemplary, and that a variety of substitutions and alterations are possible without departing from the spirit and scope of the present invention.

What is claimed is:

1. A method of using digital waveform manipulation for selectively exciting, trapping and/or ejecting a selected ion or a range of ions in a linear ion guide, comprising:

applying pairs of digital waveforms having desired duty cycles and frequencies to configured electrodes of the linear ion guide so as to establish mass stability x-y boundary conditions for the selected ion or range of ions;

phase shifting the applied pairs of digital waveforms to provide waveform periods $t_1$, $t_2$ and $t_3$; and manipulating the waveform periods of the applied pairs of digital waveforms, wherein a positive potential for the $t_2$ portion of the waveform periods provides for an axial ejection field for the selected ion or the range of ions and a negative potential for the $t_2$ portion of the waveform periods provides for an axial trapping field for the selected ion or range of ions.

2. A method of using digital waveform manipulation as in claim 1, wherein providing for a smaller difference between the $t_1$ and $t_3$ portions of the waveform periods enables a greater range of ions that can be trapped.

3. A method of using digital waveform manipulation as in claim 1, wherein manipulating the waveforms further comprises:

switching frequencies to provide frequency hopping of the applied waveforms and/or switching the duty cycle of the applied waveforms, wherein frequency hopping and/or switching the duty cycle changes the stability boundary conditions for the selected ion or range of ions.

4. A method of using digital waveform manipulation as in claim 3, wherein the frequency hopping further comprises:

applying the hopping frequency in a first manner so as to enable the selected ion or the range of ions to be moved into an unstable mass boundary region to energetically excite the selected ion or the range of ions;

applying the hopping frequency in a second manner so as to enable the selected ion or the range of ions to be moved back into a stable mass stability boundary wherein the energetically excited ions can undergo collisions to induce dissociation.

5. A method of using digital waveform manipulation as in claim 4, wherein a frequency utilized for the frequency hopping is applied for a controlled number of one or more cycles before moving back to a predetermined stable frequency.

6. A method of using digital waveform manipulation as in claim 3, wherein switching the duty cycle of the applied waveforms further comprises:

providing a frequency and a first duty cycle so that selected ion or the range of ions are in a stable mass region;

switching to a second duty cycle but keeping the frequency constant so as to induce the selected ion or the range of ions to no longer be stable;

applying the switched second duty cycle waveform for a controlled number of one or more cycles; and switching back to the first duty cycle so as to enable translational excitation to induce dissociation of the selected ion or the range of ions.

7. A method of using digital waveform manipulation as in claim 6, further comprising:

switching the duty cycle to the second duty cycle so as to introduce a high mass cutoff and a desired range of stable m/z;

manipulating the applied frequency to place the ions just inside a stable boundary region; and maintaining the manipulated applied frequency for a fixed time period to enable the selected ion or range of ions to undergo disposed buffer gas collisions within the linear ion guide so as to increase their internal energy until they dissociate.

8. A method of using digital waveform manipulation as in claim 7, wherein the manipulated applied frequency can be applied for the fixed time period of up to hundreds of milliseconds without loss of the precursor ions provided by the selected ion or the range of ions.

9. A method of using digital waveform manipulation as in claim 1, wherein during the $t_1$ and $t_3$ portions of the waveform periods, radial trapping is provided and during the $t_2$ portion of the waveform periods, a resultant potential creates an axial force near end electrodes of the linear ion guide.

10. A method of using digital waveform manipulation as in claim 1, wherein desired one or more ions resultant from the linear ion guide can be followed by controlled ion injection into a time-of flight (TOF) instrument for resolved mass analysis.

11. A method of using digital waveform manipulation as in claim 10, wherein the TOF configured with the linear ion guide provides a sampling duty cycle of about 1.

12. A method of using digital waveform manipulation as in claim 1, wherein the applied pairs of digital waveforms are provided with up to 48 bit of direct digital synthesis for trapping frequency control.

13. A method of using digital waveform manipulation as in claim 1, wherein the linear ion guide comprises a linear ion guide selected from: a quadrupole, a hexapole, an octupole, and a decapole.

* * * * *